US005917516A

United States Patent [19]

Nguyen et al.

[11] Patent Number: 5,917,516

[45] Date of Patent: Jun. 29, 1999

[54] SERVICE STATION FOR USE WITH INKJET PRINTING APPARATUS, INCLUDING COMPLIANTLY SUPPORTED SLED CARRIER, MULTI-PURPOSE POSITIONING CAM AND/OR REDUCED FOOTPRINT

[75] Inventors: Chan K. Nguyen, San Diego; Lynn D. Palmer, Escondido, both of Calif.

[73] Assignee: Hewlett-Packard Company, Palo Alto, Calif.

[21] Appl. No.: 08/753,452

[22] Filed: Nov. 25, 1996

Related U.S. Application Data

[63] Continuation-in-part of application No. 08/289,607, Aug. 12, 1994.

[51] Int. Cl.[6] ..... B41J 2/165

[52] U.S. Cl. ..... 347/32

[58] Field of Search ..... 347/32, 33, 37, 347/38, 39

[56] References Cited

U.S. PATENT DOCUMENTS

| | | | |
|---|---|---|---|
| 4,728,970 | 3/1988 | Terasawa | 347/30 |
| 5,155,497 | 10/1992 | Martin et al. | 347/30 |
| 5,164,748 | 11/1992 | Katayanagi et al. | 347/29 |
| 5,184,147 | 2/1993 | MacLane et al. | 347/30 |
| 5,257,044 | 10/1993 | Carlotta et al. | 347/32 |
| 5,394,178 | 2/1995 | Grange | 347/32 |
| 5,559,538 | 9/1996 | Nguyen et al. | 347/104 |
| 5,587,729 | 12/1996 | Lee et al. | 347/32 |

FOREIGN PATENT DOCUMENTS

| | | |
|---|---|---|
| 0313204 | 4/1989 | European Pat. Off. . |
| 0362897 | 4/1990 | European Pat. Off. . |
| 0480302 | 4/1992 | European Pat. Off. . |
| 0589582 | 3/1994 | European Pat. Off. . |
| 0201805 | 1/1990 | Japan . |

OTHER PUBLICATIONS

Search Report in European Patent Application No. 95107253.7 issued Sep. 29, 1997.

*Primary Examiner*—N. Le
*Assistant Examiner*—Thien Tran
*Attorney, Agent, or Firm*—Jerry R. Potts

[57] ABSTRACT

A service station for use in servicing one or more inkjet print cartridges includes a service station sled assembly movably attached to a service station chassis. In one embodiment, the service station includes a sled assembly that includes a cap for enclosing a printhead of a print cartridge, a sled carrier on which the sled assembly is positioned, a cam follower structure including a cam follower, a cam positioned to interact with the cam follower, a mechanism for compliantly attaching the cam follower structure to the sled carrier, and a motor adapted to move the cam. The mechanism for compliantly attaching provides a compliant support for the sled assembly that enables the sled assembly to be positioned in a capping position that ensures adequate contact between the cap and printhead, but that alleviates excessive forces that may otherwise build up between the sled assembly and the print carriage during capping as a result of moving the sled assembly too far in a direction toward the printhead. The cam is shaped so that movement of the cam to a first position causes each cap to contact a printhead of a corresponding inkjet print cartridge. Movement of the cam to a second position causes the cap to move away from the printhead and moves the wiper into a wiping position. In yet another embodiment, a service station includes a motor that is positioned so as to minimize the footprint of the service station.

23 Claims, 23 Drawing Sheets

SERVICE STATION FOR USE WITH INKJET PRINTING APPARATUS, INCLUDING COMPLIANTLY SUPPORTED SLED CARRIER, MULTI-PURPOSE POSITIONING CAM AND/OR REDUCED FOOTPRINT

CROSS-REFERENCE TO RELATED APPLICATION

This application is a continuation-in-part of U.S. patent application Ser. No. 08/289,607, entitled "Positioning of Service Station Sled Using Motor-Driven Cam," filed by Chan K. Nguyen et al. on Aug. 12, 1994, the disclosure of which is incorporated by reference herein.

BACKGROUND OF THE INVENTION

1. Field of the Invention

The present invention relates generally to inkjet printing and, in particular, to capping the printhead of an inkjet print cartridge.

2. Related Art

In inkjet printing, one or more print cartridges are inserted in a movable print carriage. Each print cartridge includes a reservoir that holds ink. The ink passes from the reservoir through a multiplicity of nozzles to be ejected from a print cartridge printhead onto a print medium. The print carriage is moved laterally back and forth, and the print medium is advanced past the print carriage to enable printing of a desired image or images on the print medium.

Inkjet print cartridge nozzles commonly become plugged with ink blobs or particulate, or otherwise contaminated with internal bubbles that prevent the nozzles from operating properly, resulting in lower print quality. Consequently, printers and facsimile machines that use inkjet printing typically include a service station that provides for spitting, wiping, capping and priming of each printhead in order to keep the nozzles clean and functioning.

During capping, a cap must be properly aligned with the corresponding printhead. Typically, for inkjet print cartridges, cap alignment must be maintained within a fraction of a millimeter of a nominal value. If the cap is misaligned, the cap can contact one or more of the nozzles and absorb ink from the nozzles through capillary action, dirtying the service station with ink and necessitating priming of the nozzles before printing again. Additionally, improper alignment can cause the cap to inadequately seal the area around the nozzles. As a result, air can enter the area around the printhead, causing the ink to dry out and clog the nozzles. Contaminants may also enter the area around the printhead, eventually causing the nozzles to become clogged.

The cap must also be positioned, in a direction perpendicular to the printhead, so that the cap fits snugly against the printhead to ensure a good seal. However, the cap should not be positioned so that the force applied by the printhead to the cap causes the cap to deform a large amount, since such deformation may result in a poor seal (producing detrimental effects as described above) or may damage the cap or printhead.

Tolerances associated with the manufacture, assembly and operation of an inkjet printing assembly can combine to result in a variation of cap alignment that is too large, or a positioning of the cap (in a direction perpendicular to the printhead) that does not produce a good seal. Such tolerances may also combine to cause positioning of parts of the printing apparatus against each other so that forces build up in parts of the printing apparatus to an unacceptably high level. Such tolerances may be associated with, for instance, positioning of the print cartridge in the corresponding stall of the print carriage, attachment of the print carriage to a print carriage movement mechanism (such as a rod) attached to a printer chassis, assembly of the various components of the service station, and attachment of the service station to the printer chassis.

During wiping, interference between the wiper and the print cartridge must be controlled within a specified dimensional tolerance to achieve the proper wiping force. Typically, for inkjet print cartridges, wiper interference must be maintained within a fraction of a millimeter of a nominal value. If the wiper interference is too small, then the wiping force will be too small and the printhead won't be adequately wiped, resulting in poor print quality and shortened print cartridge life. If the wiper interference is too large, debris will be pushed in to the nozzles, clogging one or more nozzles so that ink cannot be ejected from the nozzle or nozzles, and/or degrading the print quality by partially clogging nozzles or becoming embedded in the ink.

Frequently, the cap and the wiper are mounted on a movable service station sled. For a variety of reasons, there may be a problem with the functionality of the cap, wiper or some other part of the service station sled. For example, because of the frequent contact between the wiper and the print cartridge, the wiper may wear out. Therefore, it is desirable that the service station sled can be replaced without the necessity of replacing the remainder of the service station.

Additionally, printers must include structure for performing various functions, e.g., moving the print carriage, advancing the print medium through a printing path. It is obviously desirable to make the structure for performing these functions as simple, efficient and inexpensive as possible. In particular, it is desirable to use particular components of the printer to perform more than one function, thereby enabling the printer to be made smaller (or, equivalently, perform more functions for the same size), simpler to manufacture and less expensive to manufacture.

SUMMARY OF THE INVENTION

According to the invention, a service station for use in servicing an inkjet print cartridge includes a service station sled assembly that can be movably attached to a service station chassis. The service station chassis can be attached to a printer chassis. The inkjet print cartridge can be mounted in a print carriage which can, in turn, be movably attached to the printer chassis. During printing, ink is ejected through nozzles formed in the print cartridge. A wiper and a cap can be mounted on, or formed as part of, the sled assembly. Lateral movement of the print carriage with respect to the service station causes the wiper to wipe across a corresponding print cartridge printhead to remove ink from the printhead. Vertical movement of the sled assembly with respect to the print carriage causes the cap to enclose a corresponding print cartridge printhead after printing is completed and the print carriage is moved laterally into a capping position. The service station according to the invention can be used, for example, with a thermal inkjet printer or with a facsimile machine that uses thermal inkjet printing.

In one embodiment of the invention, apparatus for use with an inkjet printer service station includes: i) a sled assembly that includes a cap for enclosing a printhead of a print cartridge; ii) a sled carrier on which the sled assembly is positioned; iii) a cam follower structure including a cam follower; iv) a cam positioned to interact with the cam follower; v) a mechanism for compliantly attaching the cam follower structure to the sled carrier; and vi) a motor adapted to move the cam. Movement of the cam causes corresponding movement of the cam follower such that the sled assembly can be moved along an axis perpendicular to the printhead so that the cap can be moved into and out of contact with the printhead. Contact between the sled assembly and the print carriage stops movement of the sled assembly along the axis perpendicular to the printhead. The mechanism for compliantly attaching provides a compliant support for the sled assembly that enables the sled assembly to be positioned in a capping position that ensures adequate contact between the cap and printhead, but that alleviates excessive forces that may otherwise build up between the sled assembly and the print carriage during capping as a result of moving the cam follower structure too far in a direction toward the printhead.

The mechanism of the service station according to the above-described embodiment of the invention facilitates good positioning of the cap in a direction perpendicular to a corresponding print cartridge printhead. The invention minimizes the importance of closely controlling various tolerances associated with the manufacture, assembly and operation of the service station, print cartridge, print carriage and printer chassis. Additionally, the force exerted by the sled assembly against the carriage can be controlled so that the force does not become so great that the force causes damage to some part of the print carriage or the service station.

In another embodiment, a service station according to the invention includes a cam and cam follower that interact to move a sled assembly on a surface of which at least one wiper and at least one cap are mounted. The cam is formed on a cam mechanism that is movably attached to a service station chassis and the cam follower is formed as part of the sled assembly. The cam is shaped so that movement of the cam to a first position causes the cap to contact a printhead of an inkjet print cartridge. Movement of the cam to a second position causes the cap to move away from the printhead. The cam is shaped so that movement of the cam to a particular position, which could be the above-described second position, causes an edge of the wiper to extend beyond the printhead hen viewed in a direction parallel to the direction of motion of the print carriage.

In yet another embodiment, a service station according to the invention for use with inkjet printing apparatus includes a motor that is positioned so as to minimize the footprint of the service station. The motor is positioned such that, viewed in a direction perpendicular to the surface of the sled assembly, the sled assembly has a maximum width and the motor has a maximum width, the maximum width of the sled assembly being along an axis that is substantially perpendicular to the axis along which the maximum width of the motor lies.

A method according to the invention includes the steps of: i) positioning a print carriage adjacent to a service station including a sled assembly on which a cap and wiper are mounted, and ii) moving a cam of the service station such that a cam follower of the sled assembly interacts with the cam to cause movement of the sled assembly whereby a single cam effects movement of both a wiper and a cap. In a further embodiment, the step of rotating further comprises the step of positioning the cam at a position so that the cap contacts a printhead of an inkjet print cartridge. In a still further embodiment, the step of rotating further comprises the step of positioning the cam at a second position so that the cap moves away from the printhead. In another further Embodiment, the step of rotating further comprises the step of positioning the cam at a position, which can be the second position, so that an edge of the wiper distal from the sled assembly surface extends beyond the printhead of the print cartridge when viewed in a direction parallel to the direction of motion of the print carriage.

Thus, according to these latter embodiments of the invention, a sled assembly can lee moved between capping and wiping positions using a simple mechanism that is easy and inexpensive to assemble and manufacture. Further, the positioning mechanism is driven by a motor that is oriented so as to reduce the footprint of the service station.

DETAILED DESCRIPTION OF EMBODIMENTS OF THE INVENTION

Figure 1:
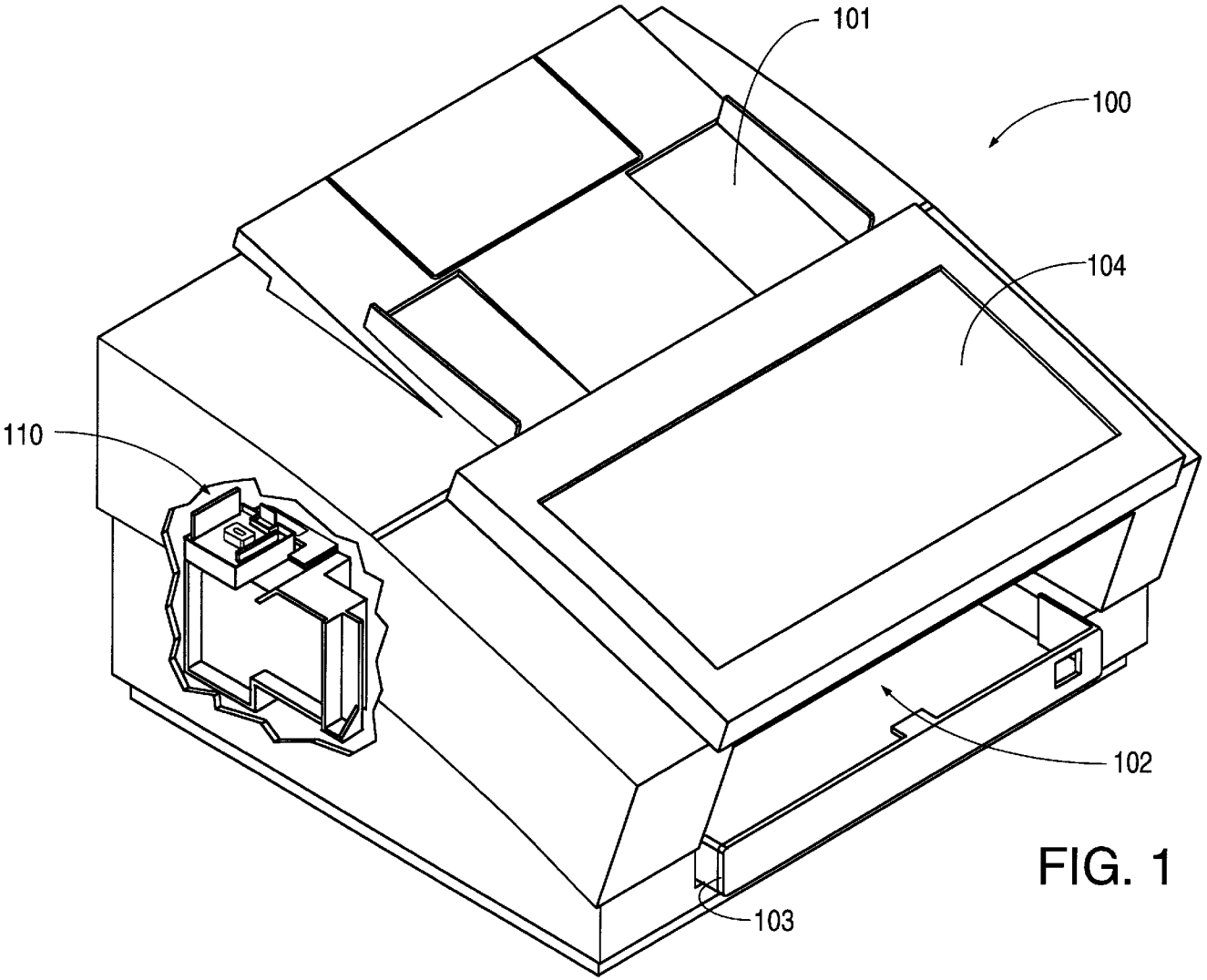
FIG. 1 is a cutaway perspective view of a facsimile machine including a service station according to one embodiment of the invention.

A service station according to the invention provides improved wiping and capping of thermal inkjet print cartridge printheads, as compared to previous service stations. A service station according to the invention can be used with either a facsimile machine that uses thermal inkjet printing, or with a thermal inkjet printer. Hereinafter, the term "printing assembly" is used to refer generically to facsimile machines or printers. Additionally, use of the term "inkjet" will be understood to include printing structures and methods referred to as "bubblejet."

A service station according to the invention can include a service station sled assembly that can be removably attached to a service station chassis. The service station chassis can be attached to a printer chassis. An inkjet print cartridge can be mounted in a print carriage which can, in turn, be mounted on a print carriage movement mechanism (e.g., rod) that is attached to the printer chassis. A wiper and a cap can be mounted on, or formed as part of, the service station sled assembly for effecting wiping and capping of a printhead of a corresponding inkjet print cartridge. Lateral movement of the print carriage with respect to the service station causes the wiper to wipe across the corresponding printhead. Vertical movement of the sled assembly with respect to the print carriage causes the cap to enclose the nozzles of the corresponding printhead after the print carriage is moved laterally into a capping position.

The service station sled assembly can be compliantly supported to alleviate forces that may otherwise build up as a result of the cumulation of tolerances associated with the manufacture, assembly and operation of an inkjet printing assembly. Thus, the sled assembly can be positioned with respect to the printhead, in a direction perpendicular to the printhead, in a manner that ensures that the cap will contact the printhead, thus ensuring that a good seal is formed by the cap around the nozzles of the printhead. Since the cap forms a better seal over the nozzles than has been the case with previous service stations, ingress of contaminants or air to the nozzles is minimized, thereby reducing clogging of the nozzles so that print quality and reliability are improved. Additionally, in some embodiments of the invention, the compliant support can be configured so that the force exerted by the printhead against the cap can be controlled to increase the likelihood that the force does not become so great that the force causes the cap to deform (which may result in a poor seal) or damage the cap or printhead.

A service station according to the invention can include an alignment mechanism that provides improved alignment, relative to previous service stations, of a cap of the sled assembly with respect to the corresponding printhead. The alignment mechanism can include alignment posts formed on one of the sled assembly or print carriage, and corresponding alignment cavities or holes formed in the other of the sled assembly or print carriage. When the print carriage is moved into a capping position, the sled assembly is moved relative to the print carriage so that the alignment posts are inserted into the alignment cavities or holes, aligning the print cartridge with the corresponding cap such that the cap fully encloses the nozzles of the print cartridge. Such an alignment mechanism minimizes the importance of closely controlling the tolerances (described above) associated with the manufacture, assembly and operation of the printing assembly.

The compliant sled assembly support and alignment mechanism described above can reduce the cost of manufacturing a printing assembly including a service station according to the invention, since it is not necessary to use expensive and/or unreliable methods for ensuring a good seal of the cap over the nozzles, such as on-line adjustment during manufacturing or tight tolerance control design.

A service station according to the invention can also include a positioning mechanism that provides good control of the amount of interference between a wiper of the sled assembly and a corresponding print cartridge to be wiped by the wiper. The positioning mechanism can include one or more guide rails formed on one of the sled assembly or print carriage that contact corresponding guide surfaces of the other of the sled assembly or print carriage. The height of the guide rails is established, relative to the position of the corresponding guide surfaces when the print carriage is positioned over the sled assembly during wiping, such that contact between the guide rail or rails and the corresponding guide surface or surfaces maintains a desired amount of interference between the wiper and the corresponding print cartridge. Consequently, the wiping force is maintained at a desired magnitude so that adequate wiping is achieved, and excessive wiper interference, that would otherwise cause debris to be pushed into the nozzles, is avoided.

The sled assembly of a service station according to the invention can be constructed so that the sled assembly can be easily detached from, or attached to, the printer chassis. Consequently, the cap, wiper or entire sled can be easily replaced by removing and replacing only the sled assembly rather than the entire service station. The removability of the sled assembly also allows the sled assembly to be more easily cleaned as desired or necessary. Additionally, the sled assembly can be removed and replaced with a different or upgraded sled assembly, without necessity to replace the entire service station or buy a new printing assembly.

A service station according to the invention can include a motor that drives a cam mechanism to move the sled assembly vertically between capping and wiping positions. The same motor can also drive another cam mechanism to position a paper pick pressure plate in either of a paper pick position, i.e., pressed against a paper pick roller, or a paper release position, i.e., positioned away from a pick roller. The rotation of the cams of the two cam mechanisms is synchronized such that when the sled assembly is in the wiping position, the pressure plate is in the paper pick position, and when the sled assembly is in the capping position, the pressure plate is in the paper release position. Thus, a single motor drives structure to perform two functions within a printing assembly that, in previous printing assemblies, required two motors. Additionally, the cam mechanisms according to the invention are integrated into a structure that is simpler and cheaper than corresponding structures in previous printing assemblies. Further, the motor is positioned so that the motor axis is perpendicular to the longest dimension of the service station (viewed in a direction perpendicular to a surface on which the wiper and cap are mounted or formed), thereby reducing the footprint of the service station.

FIG. 1 is a cutaway perspective view of a facsimile machine 100 including a service station 110 (shown in simplified form in FIG. 1 for clarity) according to the invention. The construction and operation of the service station 110 are described in greater detail below.

The facsimile machine 100 is used to send facsimile transmissions. A document to be transmitted is fed into the document guide 101, drawn into the facsimile machine 100, scanned, and then discharged out onto a retractable shelf (not shown) that can be pulled cut to extend from the upper portion of the opening 102. The data obtained from scanning the document is transmitted over communication lines, as is well known, to a remote facsimile machine, where the data is reconstructed into a reproduction of the original document.

The facsimile machine 100 is also used to receive facsimile transmissions. Print media, e.g., sheets of paper, are stacked in the input print media tray 103. When a facsimile transmission is received from a remote facsimile machine, a sheet of the print media is drawn from the input print media tray 103 into the facsimile machine 100, the facsimile transmission is reproduced onto the print medium, and the print medium is discharged into an output print media tray (not shown) that is located in the opening 102 above the input print media tray 103 and below the retractable shelf.

An operation panel 104 includes a keyboard (not shown) for inputting commands to control the operation of the facsimile machine 100. The operation panel 104 also includes a display, e.g., an LED display, for displaying various information to a user such as input commands or status information.

Figure 6:
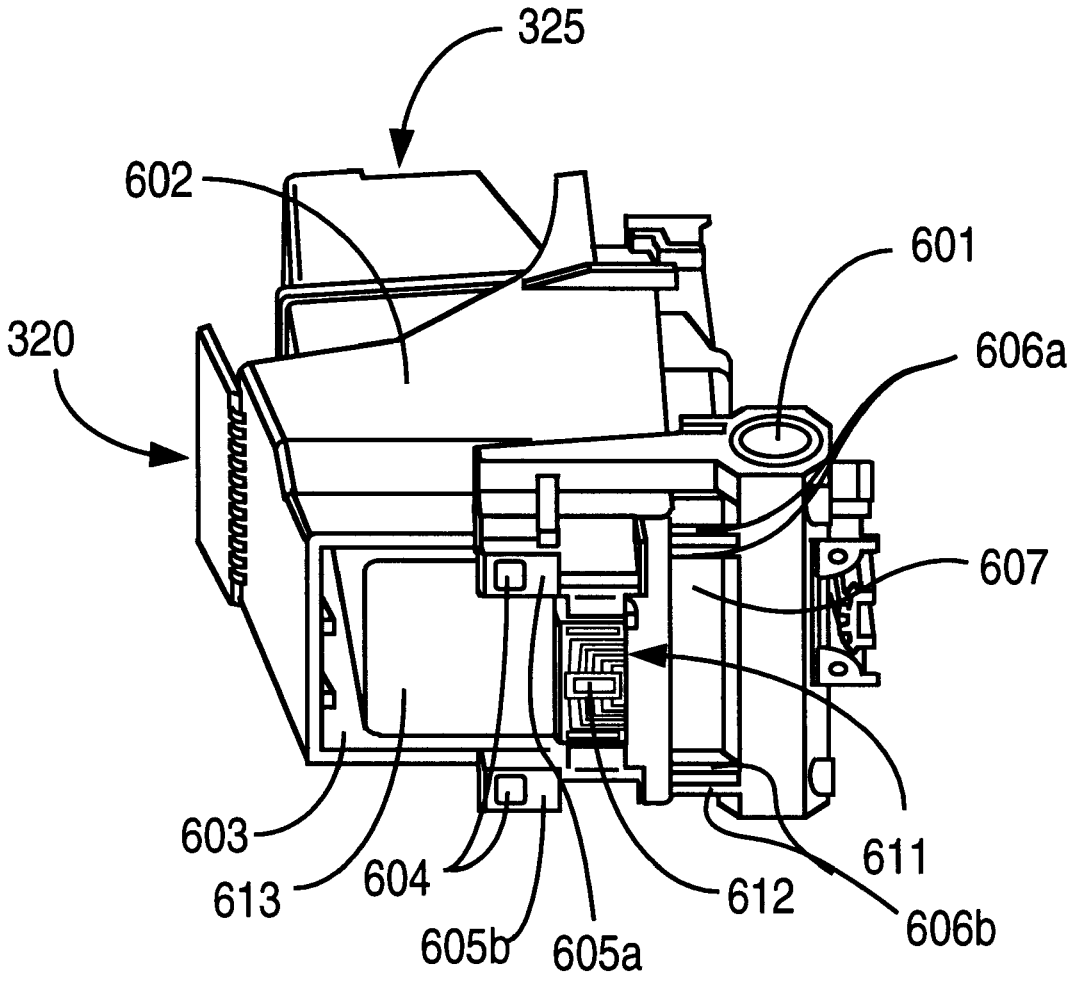
FIG. 6 is a bottom perspective view of the print carriage and print cartridge of FIG. 3.

According to the invention, reproduction of the facsimile transmission onto a print medium is done by inkjet printing. A print carriage (not shown), described in more detail below with respect to FIG. 6, is slidably mounted on a rod (not shown) within the facsimile machine 100. One or more print cartridges (see, e.g., FIGS. 3 and 6), each print cartridge having a reservoir for holding ink, are mounted in the print carriage. Each print cartridge includes a plurality of nozzles through which the ink is ejected from a print cartridge printhead onto the print medium. While the print medium is advanced past the print cartridge printhead, the print carriage is driven by a motor to move laterally back and forth along the rod, thereby enabling printing of a desired image or images on the print medium.

Each print cartridge can hold a different color ink. Generally, the inks can be of any color and, if more than one print cartridge is present, any combination of colors can be used. For example, a single print cartridge holding black ink can be mounted in the print carriage. Alternatively, three print cartridges can be mounted in the print carriage, one cartridge holding blue ink, a second cartridge holding yellow ink and a third cartridge holding magenta ink. Other configurations of print cartridges are also within the scope of the invention.

Figure 2:
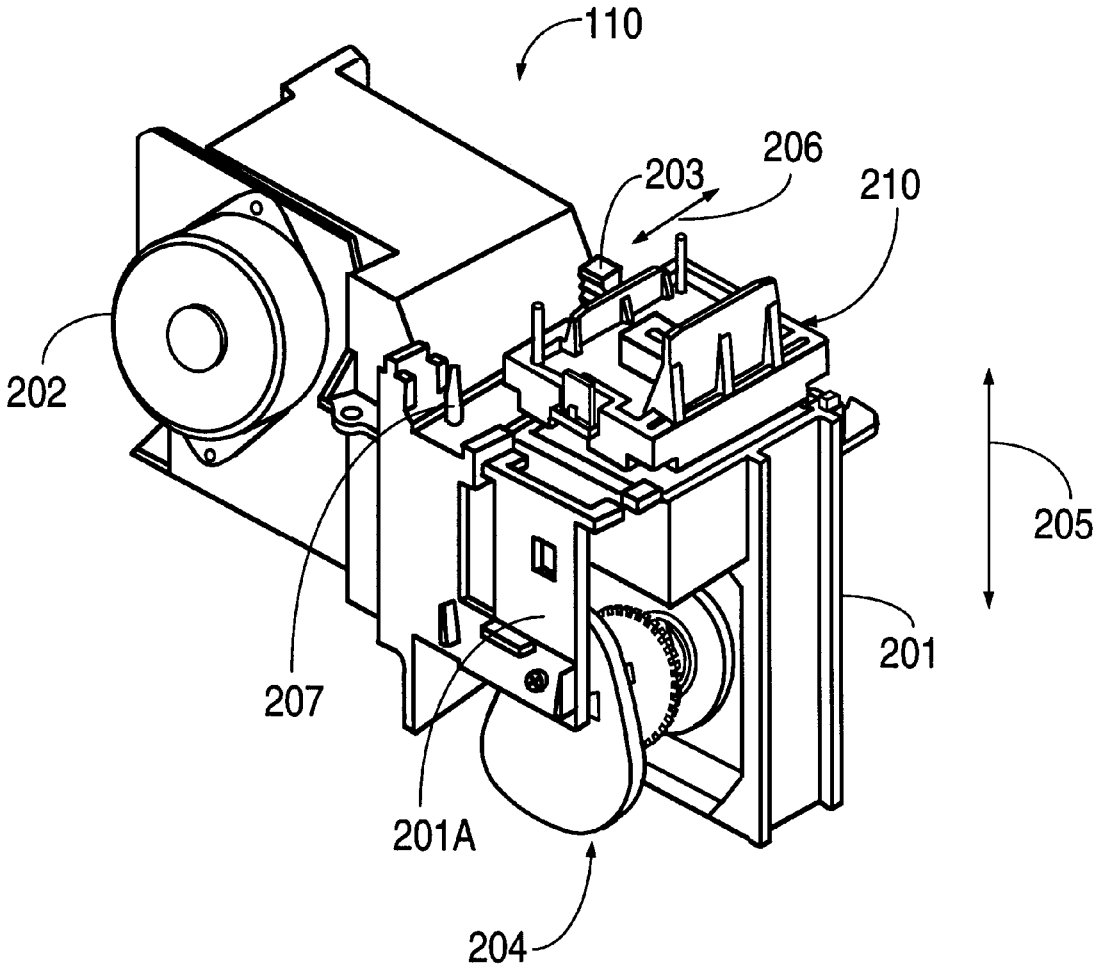
FIG. 2 is a top perspective view of the service station shown in FIG. 1.

FIG. 2 is a top perspective view of the service station 110. A sled assembly 210 (described in more detail below with respect to FIGS. 4A and 4B) is movably attached to a service station chassis 201, as described in more detail below with respect to FIGS. 7A and 7B so that the sled assembly 210 can be moved between the wiping and the capping positions. A release lever 203 is pivotably mounted within the service station chassis 201 so that the exposed portion of the release lever 203 can be moved along the bi-directional arrow 206 between a first position and a second position, the second position effecting release of the sled assembly 210 from the service station chassis 201, as described in more detail below with respect to FIG. 8, so that the sled assembly 210 can easily be disengaged from the service station chassis 201.

A conventional stepper motor 202 is mounted on the service station chassis 201. The motor 202 drives a gear train (not shown), described in more detail below with respect to FIGS. 7A and 7B, within the service station chassis 201 to effect rotation of a dual cam mechanism 204. As also described in more detail below with respect to FIGS. 7A and 7B, one cam of the dual cam mechanism 204 interacts with a corresponding cam follower to cause the sled assembly 210 to be moved vertically (i.e., along direction arrow 205) between the capping and wiping positions. As described in more detail below with respect to FIGS. 11A and 11B, the other cam of the dual cam mechanism 204 interacts with a paper pick pressure plate (not shown) to move the paper pick pressure plate between a paper pick position and a paper release position. Thus, the dual cam mechanism 204 enables a single motor to be used to move both the sled assembly 210 and the paper pick pressure plate.

A spittoon holding post 207 extends from a surface of the service station chassis 201 near the sled assembly 210. A spittoon (not shown) is positioned adjacent a wall 201*a* of the service station chassis 201 and held in place, in part, by fitting a hole formed in a flange of the spittoon over the spittoon holding post 207. The spittoon is a reservoir that holds ink ejected from the print cartridges) to clear the nozzles before printing ("spitting"). A spittoon and associated structure that can be used with the invention are described in more detail in the commonly owned U.S. Pat. No. 5,517,221, entitled "Spittoon Absorber Wetting Agent," by Chan Nguyen, issued on May 14, 1996, the disclosure of which is incorporated by reference herein.

Figure 3:
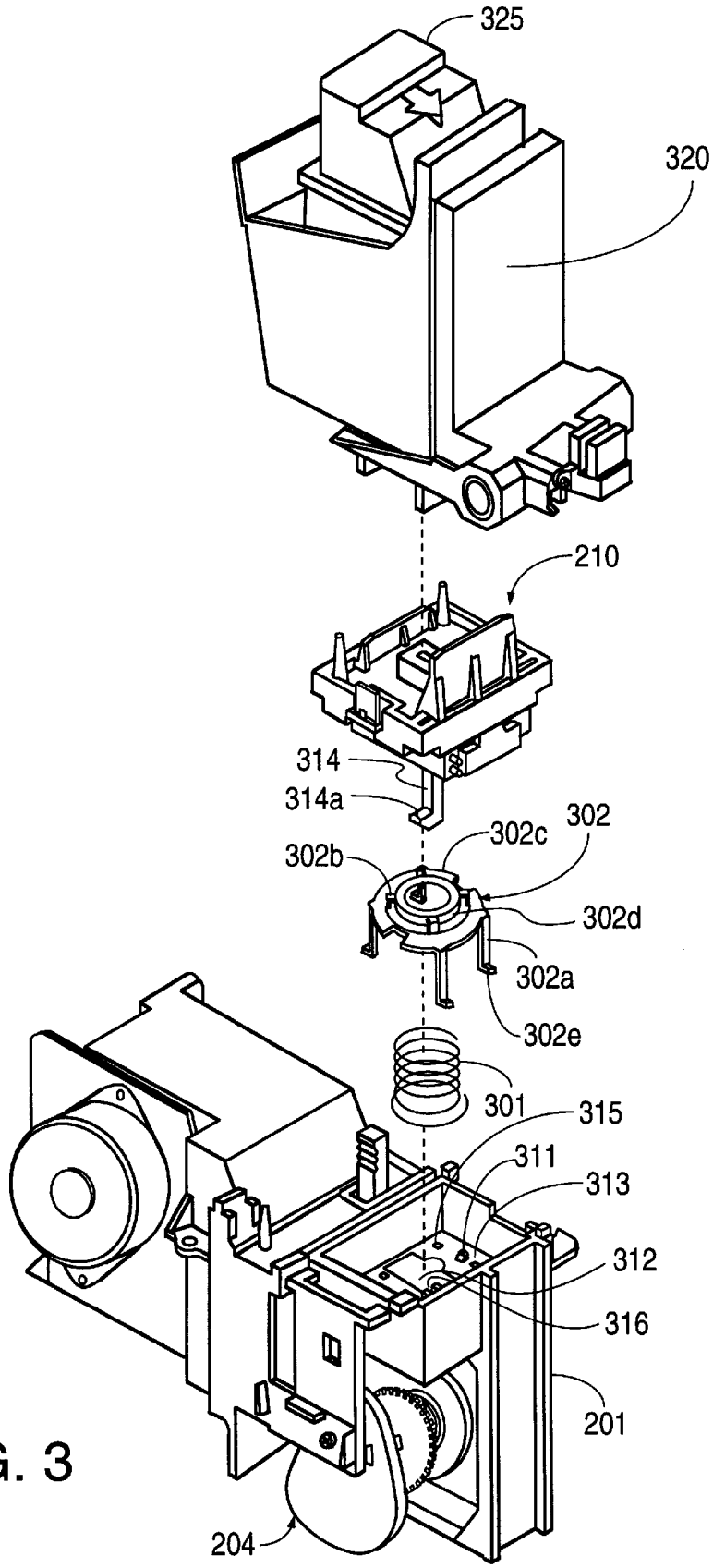
FIG. 3 is an exploded top perspective view of the service station of FIG. 2 and a print carriage positioned over the service station.

FIG. 3 is an exploded top perspective view of the service station 110 and a print carriage 320 positioned over the service station 110. A print cartridge 325 is inserted in the print carriage 320 so that a printhead of the print cartridge 325 is exposed through a hole in the print carriage 320, as shown more clearly in FIG. 6, adjacent the sled assembly 210. For clarity, some parts of the print carriage 320 are simplified in FIG. 3.

A coil spring 301 is positioned on a floor 313 of a cavity formed in the service station chassis 201. The coil of the coil spring 301 adjacent the cavity floor 313 is made larger than the rest of the coils and is fitted underneath each of two hooked retainers 311 (only one is visible in FIG. 3) formed integrally with the cavity floor 313 on opposite sides of a hole 312 formed through the cavity floor 313.

A sled assembly mount 302 is positioned over the coil spring 301 so that the coil spring 301 fits within a recess in the sled assembly mount 302 formed by outer ring section 302*c*, connecting sections 302*b* (for clarity, only one connecting section 302*b* is labelled in FIG. 3) and inner ring section 302*d*. The sled assembly mount 302 includes four legs 302*a* (for clarity, only one leg 302*a* is labelled in FIG. 3) extending from outer ring section 302*c* in a direction opposite that in which connecting sections 302*b* extend. Each leg 302*a* has a foot 302*e* (for clarity, only one foot 302*e* is labelled in FIG. 3) formed at an end of leg 302*a* distal from outer ring section 302*c*. The foot 302*e* of each leg 302*a* is fit through a corresponding one of a multiplicity of holes 315 (in FIG. 3, only three holes 315 are visible and, for clarity, only one hole 315 is labelled) formed through the cavity floor 313. The legs 302*a* are positioned with respect to each other, relative to the positioning of the holes 315 with respect to each other, so that the legs 302*a* must be slightly compressed toward one another, in a direction opposite that in which the feet 302*e* extend, to fit the feet 302*e* through the corresponding holes 315. After the feet 302*e* are fit through the holes 315, the legs 302*a* are released so that the feet 302*e* extend beyond the holes 315.

The unstretched length of the coil spring 301 and the dimensions of the sled assembly mount 302 are chosen such that the coil spring 301 is slightly compressed when the feet 302*e* of the legs 302*a* are fit through the holes 315. The compression of the coil spring 301 causes the feet 302*e* to be biased against a side of the cavity floor 313 opposite that shown in FIG. 3, thereby attaching the sled assembly mount 302 to the service station chassis 201.

The sled assembly 210 is mounted over the sled assembly mount 302. A retention leg (cam follower) 314 extends from the sled assembly 210 and fits through the hole 312 in the cavity floor 313. A foot 314*a* of the cam follower 314 contacts a cam surface formed on the dual cam mechanism 204, as explained in more detail below with respect to FIGS. 7A and 7B, to attach the sled assembly 210 to the service station chassis 201. Guide pins, described below with respect to FIGS. 4A and 4B, formed on the sled assembly 210 fit into a corresponding slot 316 formed on the service station chassis 201 within the cavity.

Figure 4A:
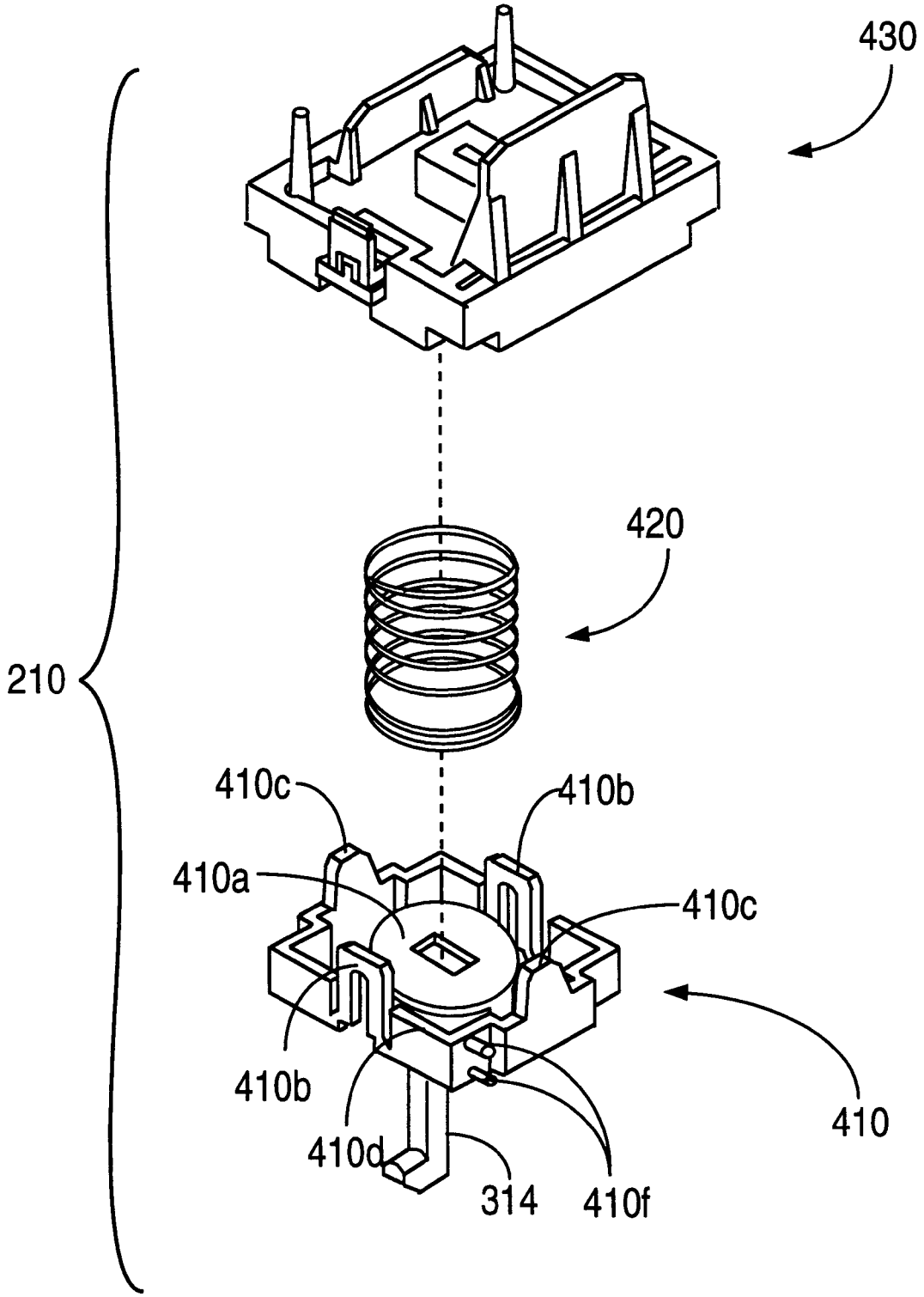
FIGS. 4A and 4B are exploded top and bottom perspective views, respectively, of the sled assembly of FIG. 3.
Figure 4B:
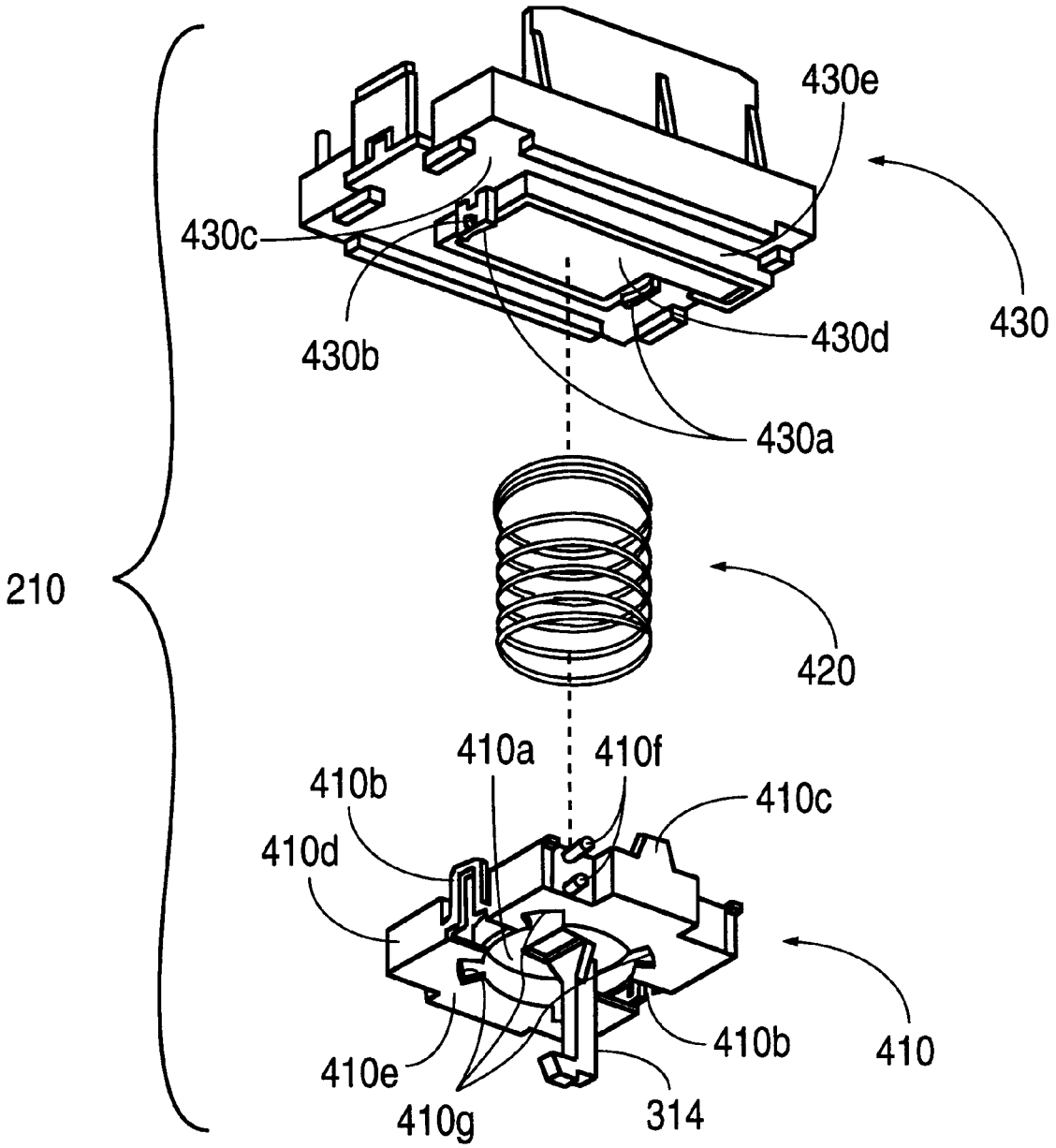

FIGS. 4A and 4B are exploded top and bottom perspective views, respectively, of the sled assembly 210. The sled assembly 210 includes a sled engagement mechanism 410, a coil spring 420, and a sled base 430.

The sled engagement mechanism 410 includes a rectangular frame 410*d* within which a circular raised section 410*a* is formed substantially concentrically with the frame 410*d* such that a recess is defined between the frame 410*d* and the raised section 410*a*. A floor 410*e* (FIG. 4B) and four connecting sections 410*g* (only three are visible in FIG. 4B) connect the frame 410*d* to the raised section 410*a*. A looped section 410*b* is formed approximately midway along each of two opposing walls of the frame 410*d*. An extending section 410*c* extends from each of the other two opposing walls of the frame 410*d* approximately midway along the wall. Cylindrical guide pins 410*f* extend from an (exterior surface of a wall of the frame 410*d*. The sled engagement mechanism 410 is made of, for example, polycarbonate.

As seen in FIG. 4B, sled base 430, described in greater detail below with respect to FIG. 5, includes two walls 430*a* extending from a surface of a floor 430*c*. A protrusion 430*b* (only one is visible in FIG. 4B) extends from each of the walls 430*a* in a direction that is substantially parallel to the floor 430*c*.

As best seen in FIG. 4A, the coil spring 420 fits into the recess formed in the sled engagement mechanism 410 around the circular raised section 410*a*. As best seen in FIG. 4B, each of the two opposing looped sections 410*b* (which are somewhat flexible) of the sled engagement mechanism 410 are bent slightly and fitted over a corresponding one of the protrusions 430*b* of the sled base 430 so that the coil spring 420 is positioned between the sled engagement mechanism 410 and the sled base 430. The coil spring 420 is held laterally in place with respect to the sled base 430 by the walls 430*a*. The unstretched length of the coil spring 420 and the length of the looped sections 410*b* are chosen so that, when the sled base 430 is attached to the sled engagement mechanism 410, the coil spring 420 is compressed. The compression of She coil spring 420 exerts a force pushing the sled engagement mechanism 410 away from the sled base 430 so that the looped sections 410*b* are held in contact against the protrusions 430*b*, thereby holding the sled base 430 in position with respect to the sled engagement mechanism 410 in a direction perpendicular to the floor 430*c*. Each of the looped sections 410*b* contacts the respective wall 430*a* to hold the sled base 430 laterally in place in a direction perpendicular to the walls 430*a*. The sled base 430 is prevented from pivoting to an unacceptable degree about the point of contact between the looped sections 410*b* and the protrusions 430*b* by contact between one or the other of the extending sections 410*c* of the sled engagement mechanism 410 with the floor 430*c* of the sled base 430.

As explained in more detail below with respect to FIG. 10A, when the print carriage 320 is moved into the capping position, the sled assembly 210 is moved relative to the service station chassis 201 and print carriage 320 into a capping position in which a cap contacts the printhead of a corresponding print cartridge. The service station 110 can be assembled so that, for a range of expected tolerances in positioning of the cap with respect to the printhead, when the sled assembly 210 is moved into a capping position, contact between the cap and the printhead is assured, thereby assuring that a good seal will be formed by contact between the cap and printhead. This car be done, without fear of potentially causing an unacceptably high contact force between the cap and the printhead, because the spring 420 compliantly supports the sled base 430. If the cap moves too far with respect to the printhead when the sled assembly 210 is moved into a capping position, the spring 420 allows the printhead to push the cap in the opposite direction, thus relieving some of the force that would otherwise build up between the printhead and the cap.

As further seen in FIG. 4B, a retainer 430*e* is formed on the floor 430*c* of the sled base 430. (The walls 430*a* are formed adjacent opposing walls of the retainer 430*e*.) A basin 430*d*, discussed in more detail below, is friction fitted into the retainer 430*e*. The basin 430*d* is made of any material that does not react wish the printing ink. In one embodiment, the basin 430*d* is made of EPDM rubber.

As noted above, the guide pins 410*f* on the sled engagement mechanism 410 fit into a corresponding slot 316 formed on the service station chassis 201. Contact between the guide pins 410*f* and the slot 316 keeps the sled assembly 210 from rocking too much as the sled assembly 210 is moved between the wiping and capping positions. Further, since discrete guide pins 410*f*, rather than a continuous guide rail, are formed, friction between the sled assembly 210 and the service station chassis 201 is minimized.

Figure 5:
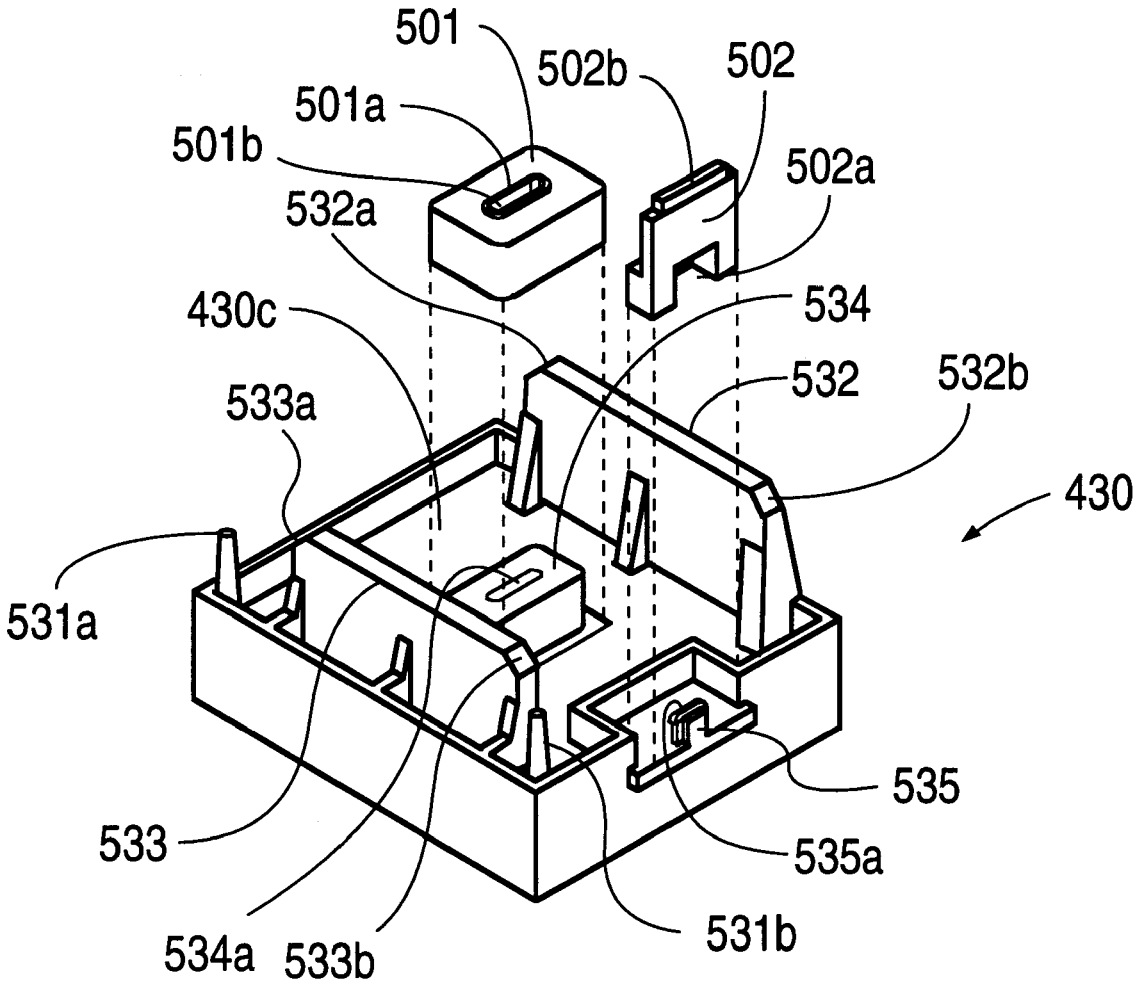
FIG. 5 is a top perspectives view of the sled base of FIGS. 4A and 4B.

FIG. 5 is a top perspective view of the sled base 430. The sled base 430 is made of any material that does not react with the printing ink. In one embodiment, the sled base 430 is made of PBT which is available from GE Plastics as Valox™.

A hollow cap 501 is friction fitted on to a cap mount 534 formed on a surface of the floor 430*c* of the sled base 430 that faces toward the printhead of the print cartridge 325 (FIG. 3) when the service station 110 is assembled into the facsimile machine 100. A hole 534*a* is centrally formed in the cap mount 534. The cap 501 includes a corresponding centrally formed hole 501*b*. The holes 501*b* and 534*a* are located above the basin 430*d* (FIG. 4B) approximately centrally with respect to the outline of the basin 430*d*. A groove (not visible in FIG. 4B) is formed in the basin 430*d* adjacent the floor 430*c*. The groove extends from a location underneath the holes 501*b* and 534*a* to a wall of the retainer 430*e*. The groove provides a path for air to escape when the printhead contacts the cap 501 to form a sealed enclosure, thereby relieving pressure that would otherwise build up against the printhead and possibly force ink from the nozzles back into the reservoir, thus necessitating priming of the print cartridge before printing can begin again. The groove is sized so that air entering the sealed enclosure through the groove does not dry out the ink at an unacceptably high rate.

The cap 501 is made of a material that does not appreciably change dimension over the expected operating life of the cap and that does not react with the printing ink. In one embodiment, the cap 501 is made of EPDM rubber. The cap 501 has a raised lip 501*a* formed around the circumference of the hole 501*b*. During capping, the lip 501*a* fits against the printhead of the print cartridge 325 to enclose the nozzles.

A wiper mount 535 is formed on a surface of the floor 430*c* that faces toward the printhead of the print cartridge 325 (FIG. 3). The wiper mount 535 includes a knobbed section 535*a* such that when a hole 502*a* formed in the wiper 502 is fitted over the knobbed section 535*a*, the wiper 502 deforms around and grips the knobbed section 535*a* so that the wiper 502 is held in place on the sled base 430. A top section 502*b* of the wiper 502 is shaped so as to make the molding of wiper 502 easier.

The height of the wiper 502 above the floor 430*c* of the sled base 430 is specified so that, viewed in a direction parallel to the direction of wiping, the wiper 502 overlaps the print cartridge 325 by a desired amount ("nominal wiper interference"). The nominal wiper interference is specified so that, within the range of expected manufacturing tolerances, the wiper 502 is certain to contact the printhead during wiping. The wiper 502 is made of a deformable material so that the wiper 502 bends during wiping. In one embodiment, the wiper 502 is made of EPDM rubber.

Alignment posts 531*a* and 531*b* extend from a surface of the floor 430*c* that faces toward the print carriage 320. The alignment posts 531*a* and 531*b* are positioned to mate with corresponding ones of alignment cavities (see FIG. 6) formed in the print carriage 320, as explained in more detail below with respect to FIGS. 10A and 10B, so that the cap 501 is properly aligned with the print cartridge printhead during capping. The alignment posts 531*a* and 531*b* preferably taper from an end distal from the floor 430*c* to an end adjacent to the floor 430*c*, for reasons explained more fully below with respect to FIG. 10A.

Though two alignment posts 531*a* and 531*b* are shown in FIG. 5, according to the invention, one, three or more alignment posts could be formed on the sled base 430. However, two or more alignment posts are preferred so that alignment of the cap 501 can be controlled along both axes defining the plane of the print cartridge printhead. Additionally, though the alignment posts 531*a* and 531*b* are shown near corners of the sled base 430, this need not be the case. Generally, an alignment post or posts according to the invention can be located anywhere on the sled base 430 so long as the alignment post or posts are properly aligned with respect to the alignment cavities formed in the print carriage 320. Further, the alignment posts need not extend from the sled base 430 in a direction perpendicular to the print cartridge printhead. The alignment posts can extend in any direction so long as the alignment posts mate with corresponding alignment cavities formed in the print carriage 320.

Guide rails 532 and 533 extend from a surface of the floor 430*c* that faces toward the print carriage 320. The guide rails 532 and 533 are positioned so that, during wiping of the print cartridge printhead, each of the guide rails 532 and 533 contacts a corresponding guide surface (see FIG. 6) of the print carriage 320, as explained in more detail below with respect to FIG. 10C. The guide rails 532 and 533 ensure that the proper amount of wiper interference is maintained during wiping. Each of the guide rails 532 and 533 is formed with chamfered corners 532*a*, 532*b* and 533*a*, 533*b*, respectively, adjacent to the edge of the guide rail 532 or 533, respectively, that contacts the print carriage 320 during wiping. When the print (carriage 320 begins to pass over the sled base 430, the print carriage 320 contacts the chamfered corners 532*a* and 533*a*, or the chamfered corners 532*b* and 533*b*, rather than the sides of the guide rails 532 and 533, so that the print carriage 320 rides smoothly onto the guide rails 532 and 533.

Though two guide rails 532 and 533 are shown in FIG. 5, according to the invention, one, three or more guide rails could be formed on the sled base 430. Two or more guide rails are preferred, since one guide rail may not precisely ensure the proper wiper interference. Additionally, though the guide rails 532 and 533 are shown near edges of the sled base 430, this need not be the case. Generally, a guide rail or rails according to the invention can be located anywhere on the sled base 430 so long as the guide rail or rails contact the print carriage 320 to produce the desired wiper interference.

FIG. 6 is a bottom perspective view of the print carriage 320 and print cartridge 325. As noted above with respect to FIG. 1, during operation of the facsimile machine 100, the print carriage 320 slides back and forth on a rod which extends through the print carriage mounting hole 601. The print cartridge 325 is inserted in a stall 602 of the print carriage 320 so that the printhead 611 of the print cartridge 325 is exposed through a hole 603 formed at the bottom of the stall 602. A multiplicity of nozzles 612, from which ink is ejected during printing, extend from the ink reservoir 613 of the print cartridge 325 to the printhead 611.

As described above, alignment cavities 604 are formed in the print carriage 320 into which alignment posts 531*a* and 531*b* (FIG. 5) of the sled base 430 extend during capping. In another embodiment, rather than alignment cavities, alignment holes are formed in the print carriage 320. The number and location of alignment cavities or holes is governed only by the number and location of the alignment posts on the sled base 430.

As also described above, during wiping of the printhead 611, each of the guide rails 532 and 533 (FIG. 5) formed on the sled base 430 contacts a corresponding guide surface of the print carriage 320. The guide rail 532 contacts the guide surfaces 606*a* and 606*b* of the print carriage 325, and the guide rail 533 contacts the guide surfaces 605*a* and 605*b*. During capping, the guide rail 532 fits within the depression 607 formed in the print carriage 325 between the guide surfaces 606*a* and 606*b* so that the sled assembly 210 (FIGS. 4A and 4B) can be raised into the capping position.

The print carriage 320 is made in two parts. The stall 602 is made of polycarbonate. The remainder of the print carriage 320, i.e., the portion including the mounting hole 601 and the guide surfaces 605*a*, 605*b*, 606*a* and 606*b* is made of a material that protects against wear resulting from the frequent contact of the guide surfaces 605*a*, 605*b*, 606*a* and 606*b* with the corresponding guide rails 532 and 533. In one embodiment, this material is a combination of materials including 75% polycarbonate, 5% teflon, 10% fiberglass and 10% carbon. The presence of the carbon increases electrical conductivity to bleed off static charge build up.

Figure 7A:
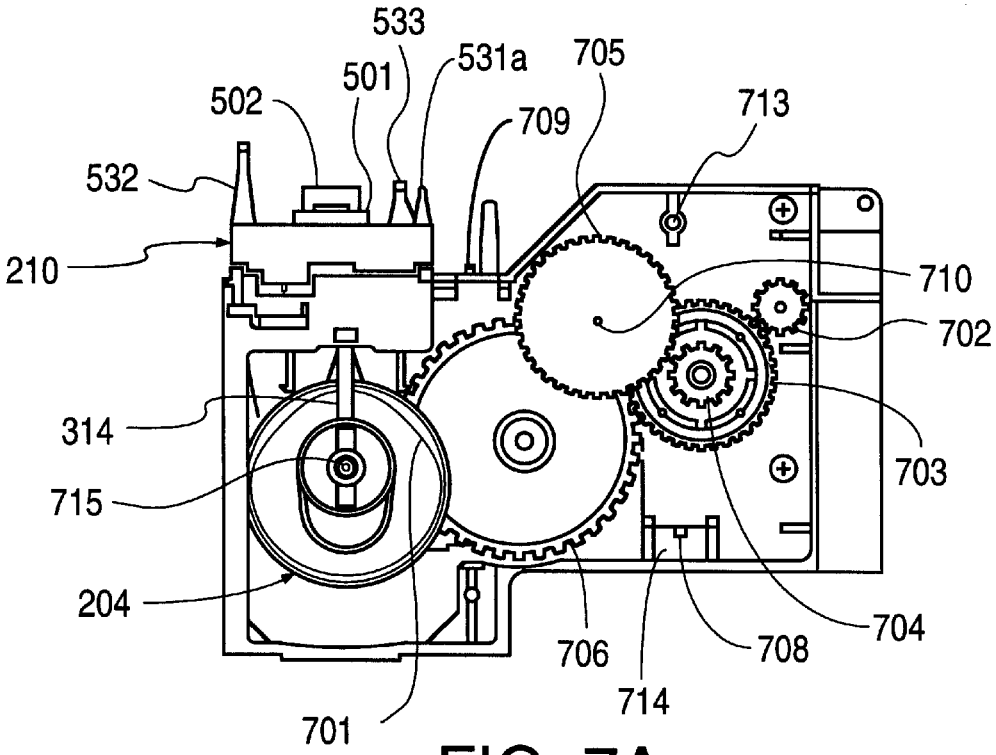
FIG. 7A is a side view of the service station chassis of the service station of FIG. 2, a side wall of the service station chassis being removed to show the interior of the service station chassis, with the sled assembly in a lowered position.

FIG. 7A is a side view of the service station chassis 201 (FIG. 2) of the service station 110, a side wall of the service station chassis 201 being removed to show the interior of the service station chassis 201, with the sled assembly 210 in a lowered position. The sled assembly 210 is in this lowered position during wiping (see FIGS. 10C and 10D below) and just prior to capping (see FIG. 10B below). The sled assembly 210 is positioned in the lowered position by contact between the cam follower 314 and a cam ring 701 (described in more detail with respect to FIG. 9B below) formed on the dual cam mechanism 204.

Figure 7B:
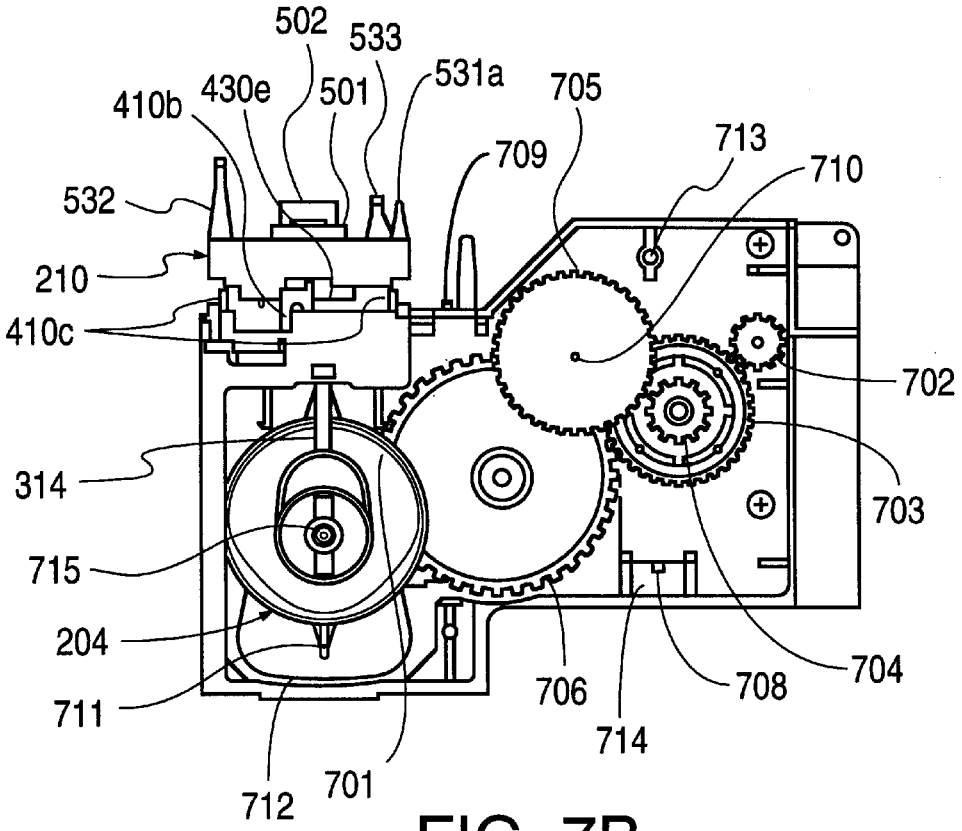
FIG. 7B is a side view of the service station chassis of the service station of FIG. 2, a side wall of the service station chassis being removed to show the interior of the service station chassis, with the sled assembly in a raised position.

FIG. 7B is a side view of the service station chassis 201 similar to that of FIG. 7A, a side wall of the service station chassis 201 being removed to show the interior of the service station chassis 201, with the sled assembly 210 in a raised position. The sled assembly 210 is in this raised position during capping (see FIG. 10A below). The sled assembly 210 is positioned in the raised position by contact between the cam follower 314 and the cam ring 701, the dual cam mechanism 204 having been rotated into a different position than that shown in FIG. 7A so that the cam follower 314 contacts a different portion of the cam ring 701. The raised and lowered positions occur as a consequence of the asymmetric mounting of the dual cam mechanism 204 on the shaft 715.

The sled assembly 210 is held in place by contact between the foot 314*a* (FIG. 3) of the cam follower 314 and the cam ring 701. As explained in more detail below with respect to FIGS. 9A through 9C, the dual cam mechanism 204 is spring-loaded so that a first cam mechanism (of which cam ring 701 is part) is biased in a direction out of the plane of FIGS. 7A and 7B, i.e., against the foot 314*a*. Thus, since the cam follower 314 is held substantially fixed along an axis perpendicular to the plane of FIGS. 7A and 7B, the biasing force of the first cam mechanism prevents the foot 314*a* from moving around the edge of the cam ring 701 and disengaging from the cam ring 701.

In FIG. 7B, the cam 712 of the dual cam mechanism 204 is visible. As described in more detail below with respect to FIGS. 11A through 11C, the cam 712 contacts a paper pick pressure plate to move the paper pick pressure plate between a paper pick position and a paper release position.

The dual cam mechanism 204 is rotated as follows. The motor 202 (FIG. 2) drives a gear 702 to rotate. The gear 702 meshes with a gear 703 to cause the gear 703 to rotate. The gear 703 is formed integrally and coaxially with a gear 704 so that rotation of the gear 703 causes the gear 704 to rotate. The gear 704 meshes with a gear 705 to cause the gear 705 to rotate. The gear 705 is formed integrally and coaxially with a smaller cylinder gear (not visible in FIGS. 7A and 7B) so that rotation of the gear 705 causes the cylinder gear to rotate. The cylinder gear meshes with a gear 706 to cause the gear 706 to rotate. The gear 706 meshes with a gear (not visible in FIGS. 7A and 7B, see gear 903*e* in FIGS. 9A and 9C) formed as part of the dual cam mechanism 204 between the first cam mechanism (FIGS. 9A through 9C) including the cam ring 701 and a second cam mechanism (FIGS. 9A through 9C) including the cam 712, thereby causing the dual cam mechanism 204 to rotate.

In one embodiment of the invention, the gear 702 is made of brass, the gear 706 is made of nylon and the remainder of the gears (gears 703, 704, 705 and the cylinder gear not visible in FIGS. 7A and 7B) are made of polycarbonate. The use of the above-described materials for the various gears was found to reduce gear wear and gear noise.

A sensor trigger 711 is formed integrally with the first cam mechanism of the dual cam mechanism 204. As the dual cam mechanism 204 rotates, the sensor trigger 711 contacts an electrical contact, sending an electrical signal to a microprocessor in facsimile machine 100 to indicate the rotational position of the dual cam mechanism 204. Thus, the microprocessor can monitor whether the sled assembly 210 is in the capping (raised) position or the wiping (lowered) position. The microprocessor uses the information regarding the position of the sled assembly 210 to coordinate motion of the print carriage 320 with the position of the sled assembly 210.

Figure 8A:
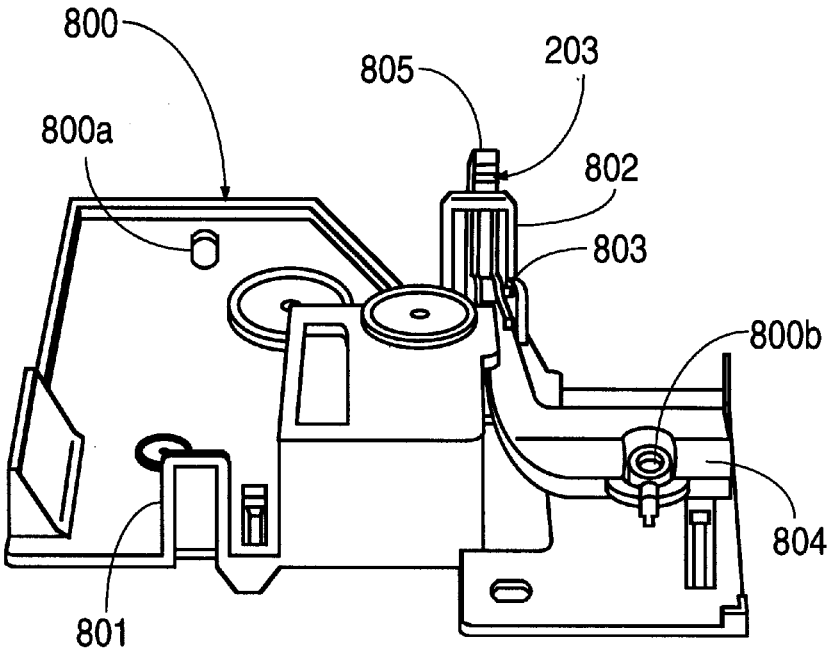
FIG. 8A is a side perspective view of the side wall of the service station chassis that is removed in FIGS. 7A and 7B, illustrating the interior of the service station chassis as viewed in a direction opposite that of FIGS. 7A and 7B.
Figure 8B:
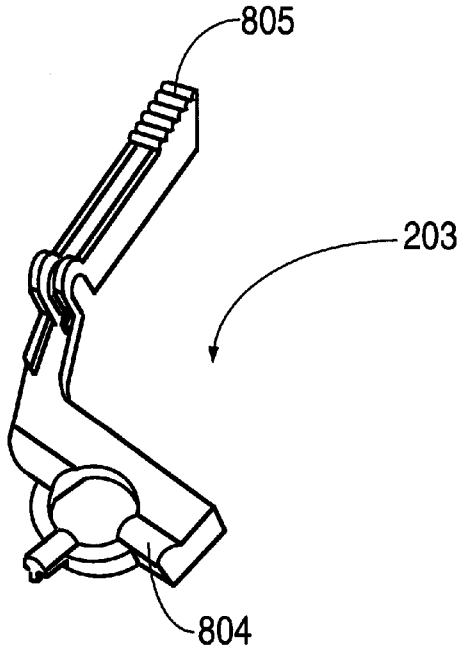
FIG. 8B is a perspective view of the release lever shown in FIG. 8A.

FIG. 8A is a side perspective view of the side wall 800 of the service station chassis 201 (FIG. 2) that is removed in FIGS. 7A and 7B, illustrating the interior of the service station chassis 201 as viewed in a direction opposite that of FIGS. 7A and 7B. FIG. 8B is a perspective view of the release lever 203 shown in FIG. 8A. The wall 800 is attached to the remainder of the service station chassis 201 by a screw that fits through a slot 800*a* in the wall 800 into a threaded hole 713 (FIGS. 7A and 7B) in a boss formed on a wall of the service station chassis 201, and by a screw (not shown) that fits through the hole 800*b* in the wall 800 into a threaded hole formed in the shaft 715 (FIGS. 7A and 7B) on which the dual cam mechanism 204 is mounted. Additionally, a looped section 801 extends from the side wall 800 such that, when the side wall 800 is assembled to the remainder of the service station chassis 201, the looped section 801 fits through a hole 714 (FIGS. 7A and 7B) formed in the service station chassis 201 and over a protrusion 708. Likewise, a looped section 802 extends from the side wall 800 such that, when the side wall 800 is assembled to the remainder of the service station chassis 201, the looped section 802 fits over a protrusion 709 (FIGS. 7A and 7B) formed on the service station chassis 201.

The release lever 203 is pivotably mounted on a boss 803 extending from a wall of the service station chassis 201. An actuating arm 805 of the release lever 203 extends through the looped section 802 above the service station chassis 201 (see FIG. 2). A release arm 804 of the release lever 203 is positioned within the service station chassis 201. In a first position of the actuating arm 805, the release arm 804 does not contact the dual cam mechanism 204 (FIGS. 7A and 7B). When the actuating arm 805 is moved in the direction of the arrow 206 (FIG. 2), the release lever 203 pivots about the boss 803 such that the release arm 804 contacts the dual cam mechanism 204, moving the spring-loaded first cam mechanism (described below with respect to FIGS. 9A through 9C) of the dual cam mechanism 204 in a direction perpendicular to the plane of FIGS. 7A and 7B. When the actuating arm 805 is moved to a second position, the first cam mechanism is moved sufficiently far so that the cam follower 314 is released from contact with the cam ring 701 (FIGS. 7A and 7B), thereby disengaging the sled assembly 210 from the service station 110 (FIG. 2).

Figure 9A:
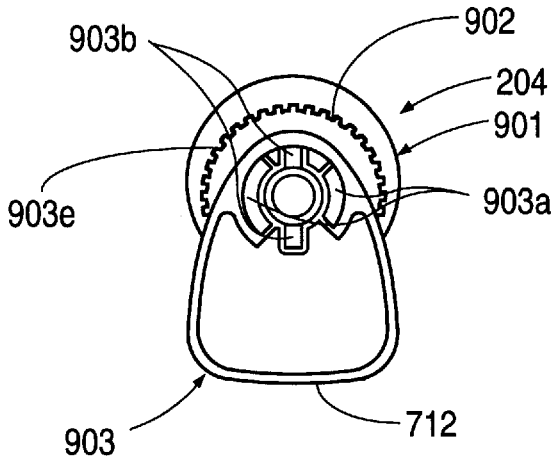
FIGS. 9A, 9B and 9C are a front view, a back view and an exploded perspective view, respectively, of the dual cam mechanism shown in FIGS. 7A and 7B.
Figure 9B:
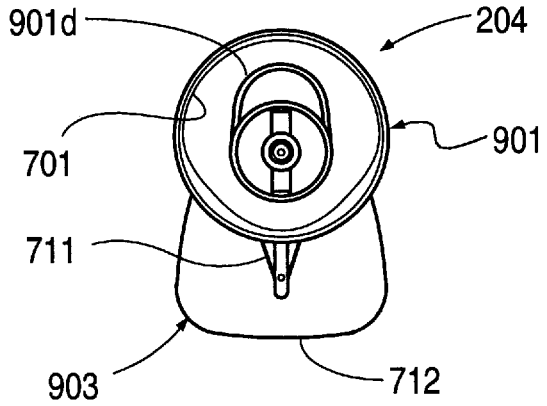
Figure 9C:
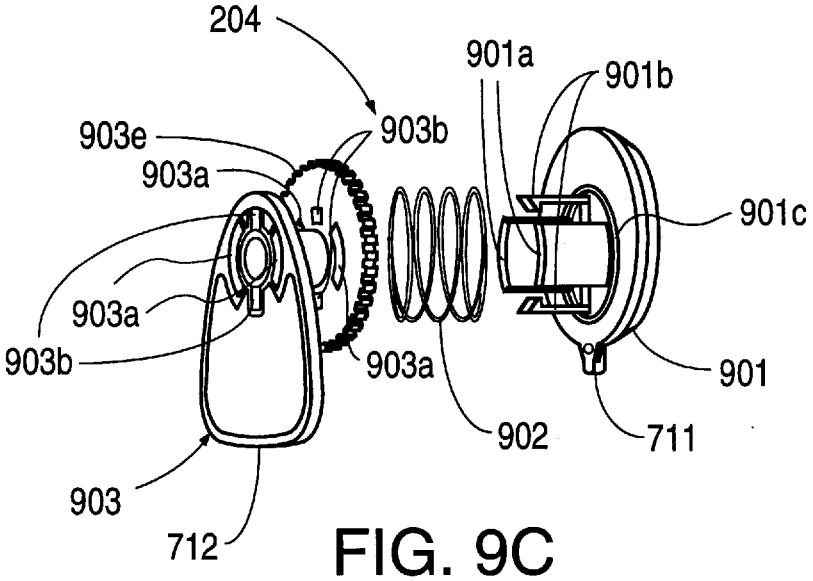

FIGS. 9A, 9B and 9C are a front view, a back view and an exploded perspective view, respectively, of the dual cam mechanism 204. The dual cam mechanism 204 includes a first cam mechanism 901, a coil spring 902, and a second cam mechanism 903.

Extensions 901*a* and 901*b* (FIG. 9C) are formed on one side of the first cam mechanism 901. A circular ridge 901*c* is formed around the extensions 901*a* and 901*b* on the same side of the first cam mechanism 301. The cam ring 701 (FIG. 9B) is formed on an opposite side of the first cam mechanism 901. The cam ring 701 is contoured so that contact between the cam follower 314 (FIGS. 7A and 7B) and the cam ring 701 provides desired motion of the sled assembly 210 when the dual cam mechanism 204 is rotated. A raised contour 901*d* is formed on the same side of the first cam mechanism 901 as the cam ring 701. The contour 901*d* restricts downward motion of the cam follower 314 during capping so that the coil spring 301 (FIG. 3) is not compressed and only the coil siring 420 (FIGS. 4A and 4B) is compressed to provide the capping force.

As best illustrated in FIG. 9C, the second cam mechanism 903 includes the gear 903*e* formed integrally with the cam 712. Holes 903*a* and 903*b* are formed through the cam 712, and holes 903*c* and 903*d* are formed through the gear 903*e*.

The coil spring 902 fits within the circular ridge 901*c* and around the extensions 901*a* and 901*b* of the first cam mechanism 901. The second cam mechanism 903 is positioned against the coil spring 902 so that the coil spring 902 fits within a circular ridge (not visible in FIGS. 9A, 9B and 9C) formed on a surface of the gear 903*e* opposite the surface on which the cam 712 is integrally formed. The first cam mechanism 901 and the second cam mechanism 903 are pressed together, compressing the coil spring 902, so that the extensions 901*a* fit through the holes 903*c* and the extensions 901*b* fit through the holes 903*d*. The compressed coil spring 902 exerts a force that pushes the first cam mechanism 901 away from the second cam mechanism 903, causing snaps formed at the end of the extensions 901*b* to contact the gear 901*e*, thereby holding the first cam mechanism 901 and the second cam mechanism 903 together.

When the release arm 804 (FIG. 8) moves the first cam mechanism 901 toward the second cam mechanism 903 to disengage the sled assembly 110 from the service station 210, the extensions 901*a* and 901*b* of the first cam mechanism 901 fit through the holes 903*a* and 903*b* in the cam 712 so that the cam 712 does not contact the extensions 901*a* and 901*b* and prevent the first cam mechanism 901 from moving.

Figure 10A:
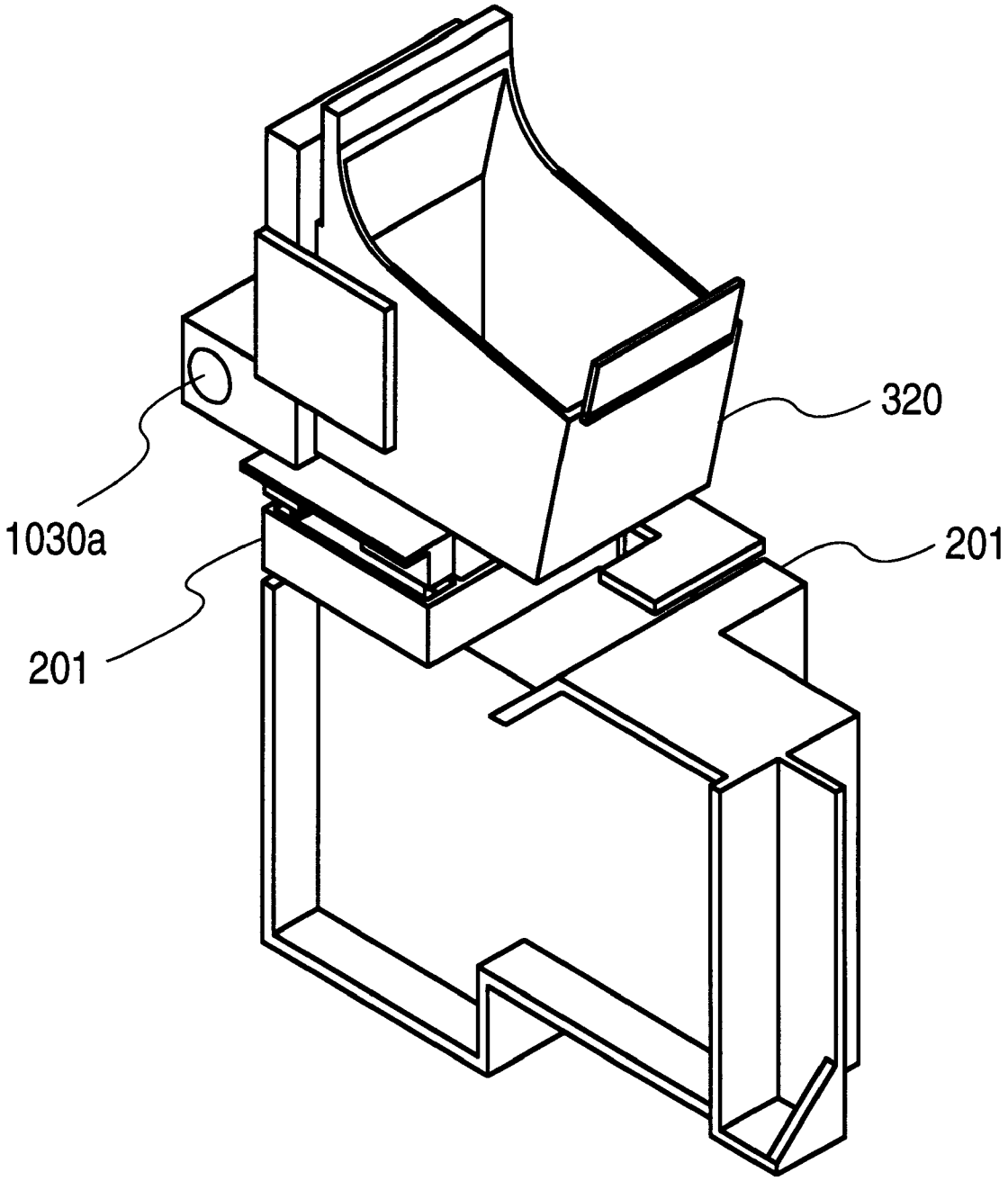
FIG. 10A is a simplified top perspective view of a portion of the service station chassis, sled assembly, and print carriage of FIG. 3, illustrating the print carriage in the capping position.

FIG. 10A is a simplified top perspective view of a portion of the service station chassis 201, sled assembly 210, and print carriage 320, as shown in FIG. 3, illustrating the print carriage 320 in the capping position. In the capping position, as shown in FIG. 7B, the dual cam mechanism 204 is rotated so that the portion of the cam ring 701 farthest from the shaft 715 is positioned nearest the sled assembly 210, thereby forcing the cam follower 314, and thus the sled assembly 210, to move upward (as viewed in FIG. 10A) relative to the service station chassis 201 and print carriage 320. When the sled assembly 210 is moved upward, alignment posts 531*a* and 531*b* (FIG. 10C) that extend from the surface 430*c* of the sled assembly 210 move upward into corresponding alignment cavities (not visible in FIGS. 10A through 10D, see FIG. 6) formed in the print carriage 320. As a result, the sled assembly 210 is held in a predetermined position with respect to the print carriage 320 so that the cap 501 (FIG. 10C) mounted on the sled assembly 210 is properly positioned over the printhead of the print cartridge (not shown) that is inserted into the print carriage 320.

The alignment posts 531*a* and 531*b* are preferably tapered so that the cross-sectional area of the alignment posts 531*a* and 531*b* (in a plane that is substantially perpendicular to the direction in which the alignment posts 531*a* and 531*b* extend) is smallest at the end distal from the surface 430*c*. The cross-sectional area of the distal end of each of the alignment posts 531*a* and 531*b* is made smaller than the cross-sectional area of the corresponding alignment cavities, and the distal end of each alignment post 531*a* and 531*b* is rounded so that slight misalignment of the sled assembly 210 (i.e., the alignment posts 531*a* and 531*b*) with respect to the print carriage 320 (i.e., the alignment cavities) during capping is accommodated, i.e., the alignment posts 531*a* and 531*b* are guided into the corresponding alignment cavities by the rounded ends of the alignment posts 531*a* and 531*b*. The relatively large cross-sectional area of the alignment posts 531*a* and 531*b* proximal to the surface 430*c* provides strength.

Figure 10B:
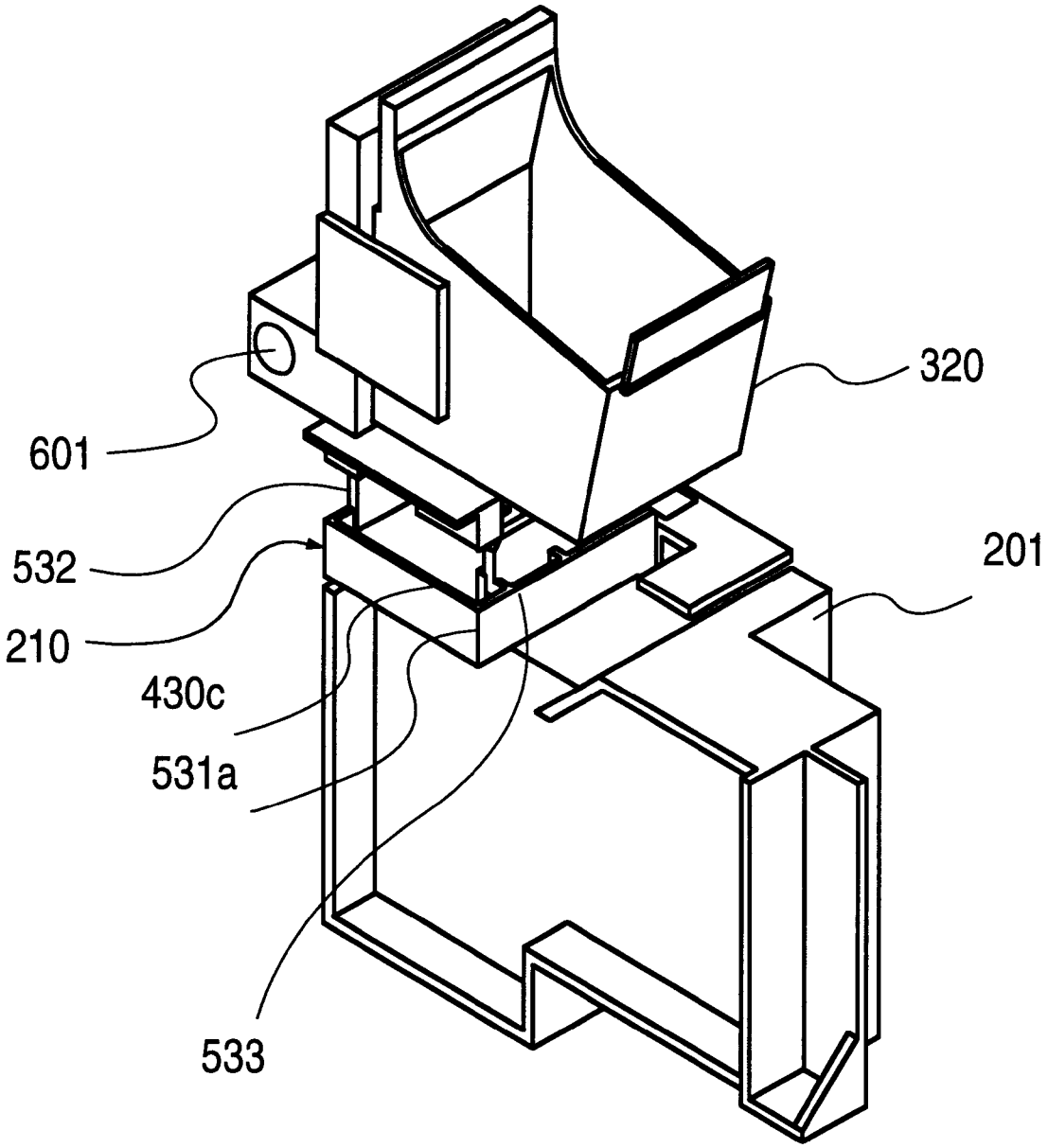
FIG. 10B is a top perspective view of the simplified service station chassis, sled assembly, and print carriage of FIG. 10A, illustrating the print carriage in a position intermediate between the capping position and the wiping position.

FIG. 10B is a top perspective view of the simplified service station chassis 201, sled assembly 210, and print carriage 320, illustrating the print carriage 320 in a position intermediate between the capping position and the wiping position. In this position, as shown in FIG. 7A, the dual cam mechanism 204 is rotated so that the portion of the cam ring 701 closest to the shaft 715 is positioned nearest the sled assembly 210, thereby forcing the cam follower 314, and thus the sled assembly 210, to move downward (as viewed in FIG. 10A) relative to the service station chassis 201 and the print carriage 320. When the sled assembly 210 is moved downward, the alignment posts 531*a* and 531*b* (FIG. 10C) move downward out of the corresponding alignment cavities so that the print carriage 320 is free to move laterally with respect to the sled assembly 210.

Figure 10C:
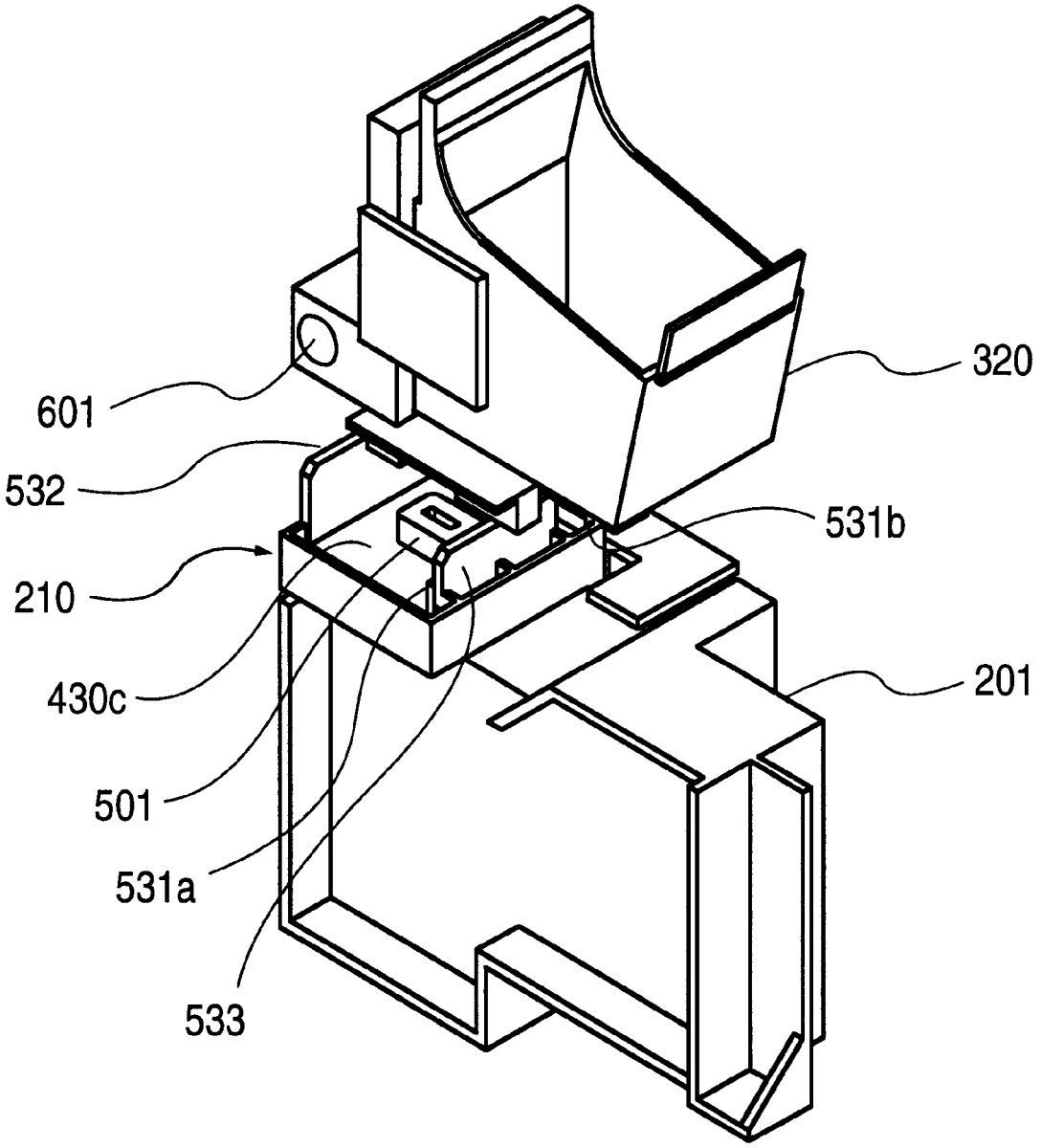
FIG. 10C is a top perspective view of the simplified service station chassis, sled assembly, and print carriage of FIG. 10A, illustrating the print carriage in the wiping position.

FIG. 10C is a top perspective view of the simplified service station chassis 201, sled assembly 210, and print carriage 320, illustrating the print carriage 320 in the wiping position. After the sled assembly 210 is moved into the intermediate position shown in FIG. 10B, the print carriage 320 is moved laterally away from the sled assembly 210. As a result of this lateral movement, the wiper 502 (FIG. 10D) wipes the printhead of the print cartridge inserted in the stall of the print carriage 320, removing ink and contaminants from the printhead.

Figure 10D:
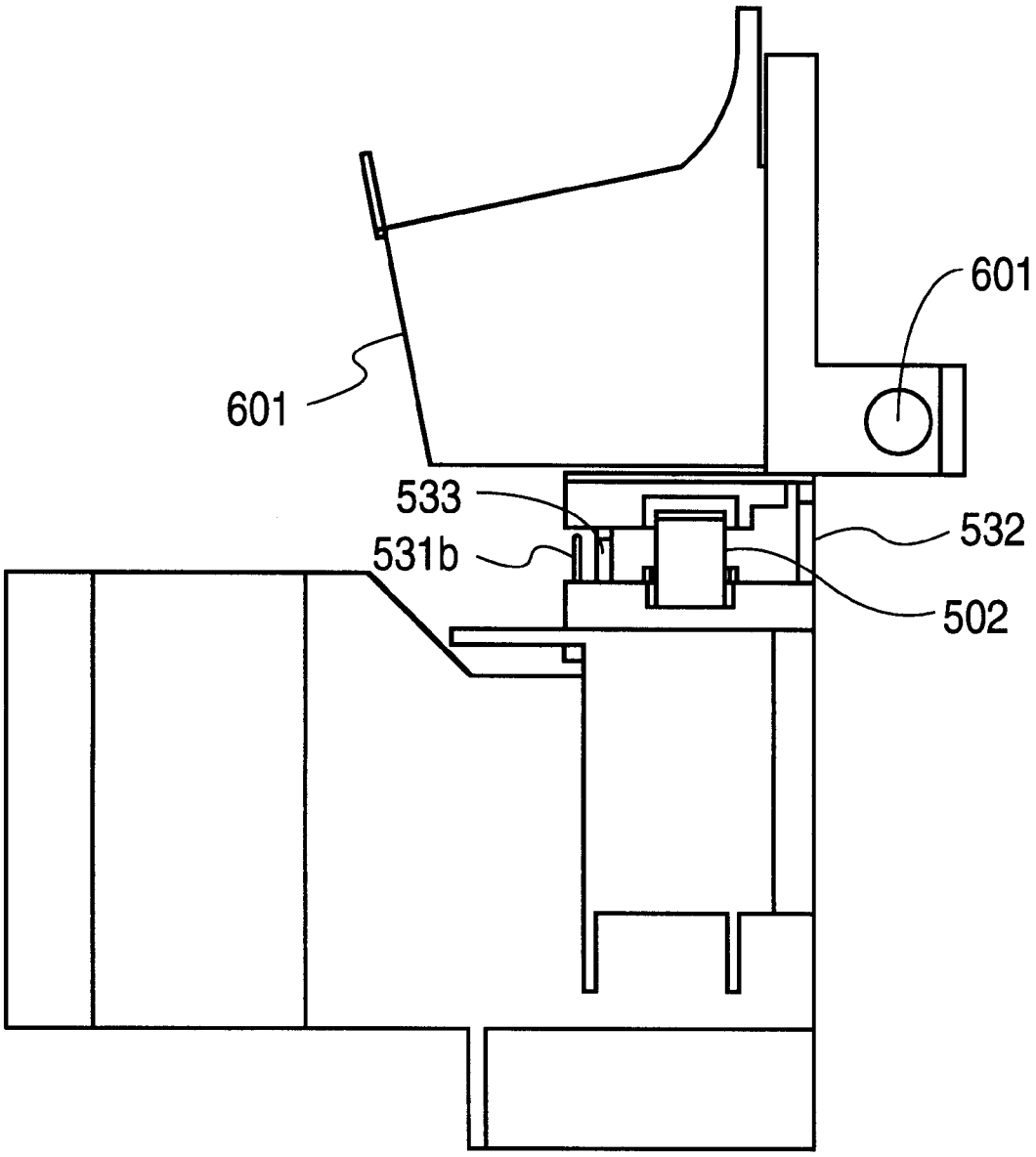
FIG. 10D is a side view of the simplified service station chassis, sled assembly and print carriage of FIG. 10A, illustrating the wiping position.

FIG. 10D is a side view of the simplified service station chassis 201, sled assembly 210 and print carriage 320, illustrating the wiping position. The print carriage 320 is positioned with respect to the sled assembly 210 to ensure that, during lateral movement of the print carriage 320, the print carriage 320 will contact the guide rails 532 and 533 formed on the sled assembly 210. As the print carriage 320 moves laterally away from the sled assembly 210, riding on the guide rails 532 and 533, the end of the wiper 502 extends beyond the printhead of the print cartridge by a predetermined amount (when viewed in a direction parallel to the direction of motion of the print carriage 320) due to the height of the guide rails 532 and 533. Thus, the guide rails 532 and 533 ensure that the wiper 502 is properly positioned to achieve proper wiping force of the wiper 502 against the printhead.

The print carriage 320 is moved laterally so that the wiper 502 wipes the entire printhead. After wiping, the nozzles are spitted, as described above and in the above-referenced U.S. patent application Ser. No. 08/241,813. The print carriage can then be moved back to the intermediate position (FIG. 10B) if desired, resulting in wiping of the printhead once again. At this point, the sled assembly 210 can be raised to the capping position (FIG. 10A), or the print carriage 320 can be moved laterally to effect wiping and spitting again. The back and forth movement of the print carriage 320 can be executed as many times as necessary to achieve a desired amount of wiping. Eventually, after moving from the intermediate position through the wiping position, the print carriage 320 is moved away from the service station 110 to allow printing.

Figure 11A:
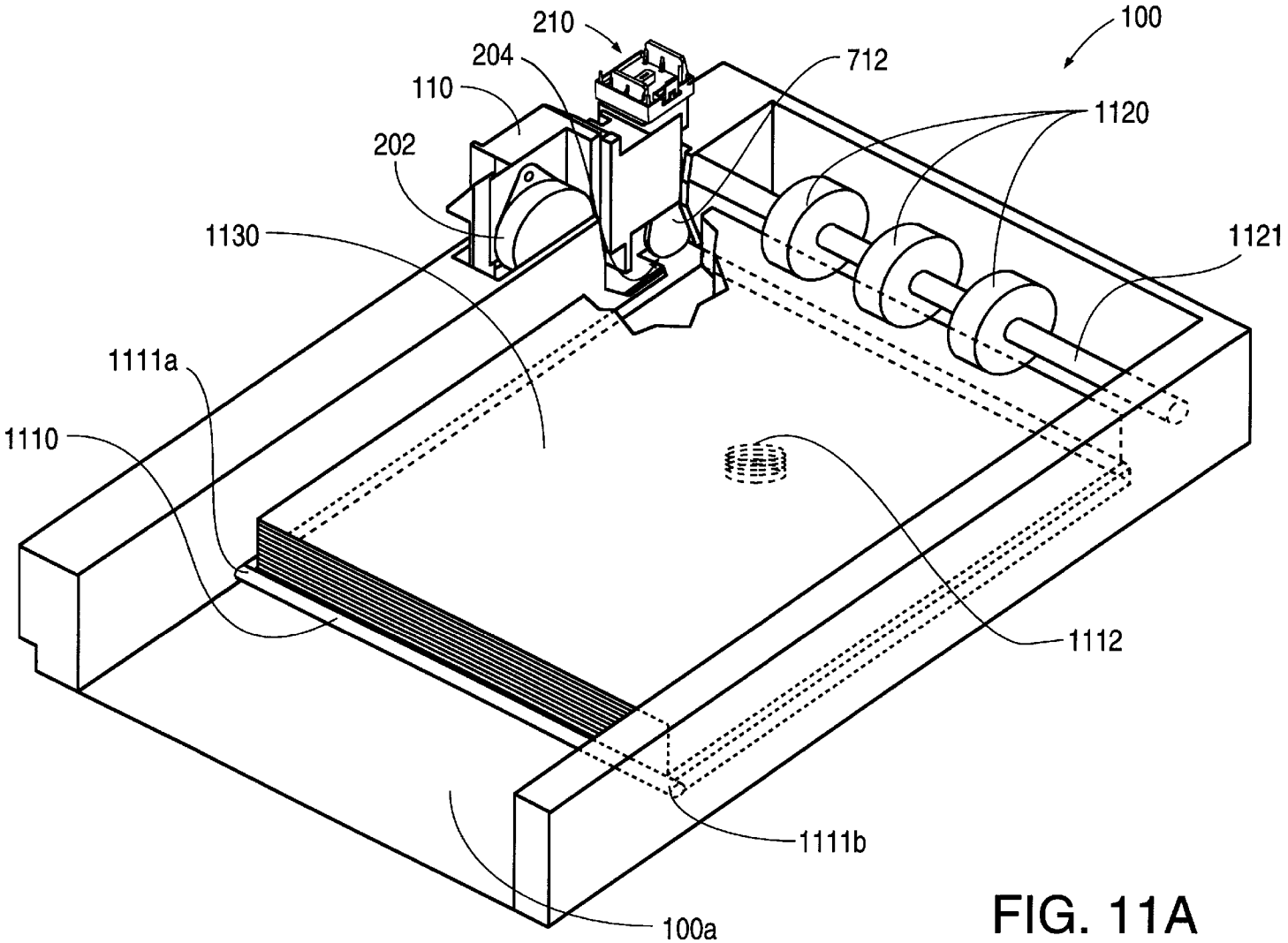
FIG. 11A is a simplified cutaway perspective view of the facsimile machine of FIG. 1 illustrating a paper pick pressure plate positioned in a paper release position.

FIG. 11A is a simplified cutaway perspective view of the facsimile machine 100 illustrating a paper pick pressure plate 1110 positioned in a paper release position. Pick rollers 1120 are attached to a shaft 1121 that is rotatably mounted near one end of the facsimile machine 100. The service station 110 is positioned near the same end of the facsimile machine 100. The paper pick pressure plate 1110 is rotatably mounted with hinges 1111*a*, 1111*b* in the facsimile machine 100 near an end of the facsimile machine 100 distal from the end at which the shaft 1121 and pick rollers 1120 are mounted. A compressed coil spring 1112 is positioned within a well formed in the bottom plate 100*a* of the facsimile machine 100 near an end of the paper pick pressure plate 1110 distal from the hinged end. The coil spring 1112 contacts the paper pick pressure plate 1110, the compression of the coil spring 1112 causing the paper pick pressure plate 1110 to be biased about the hinges 1111*a* and 1111*b* toward the pick rollers 1120.

Figure 11B:
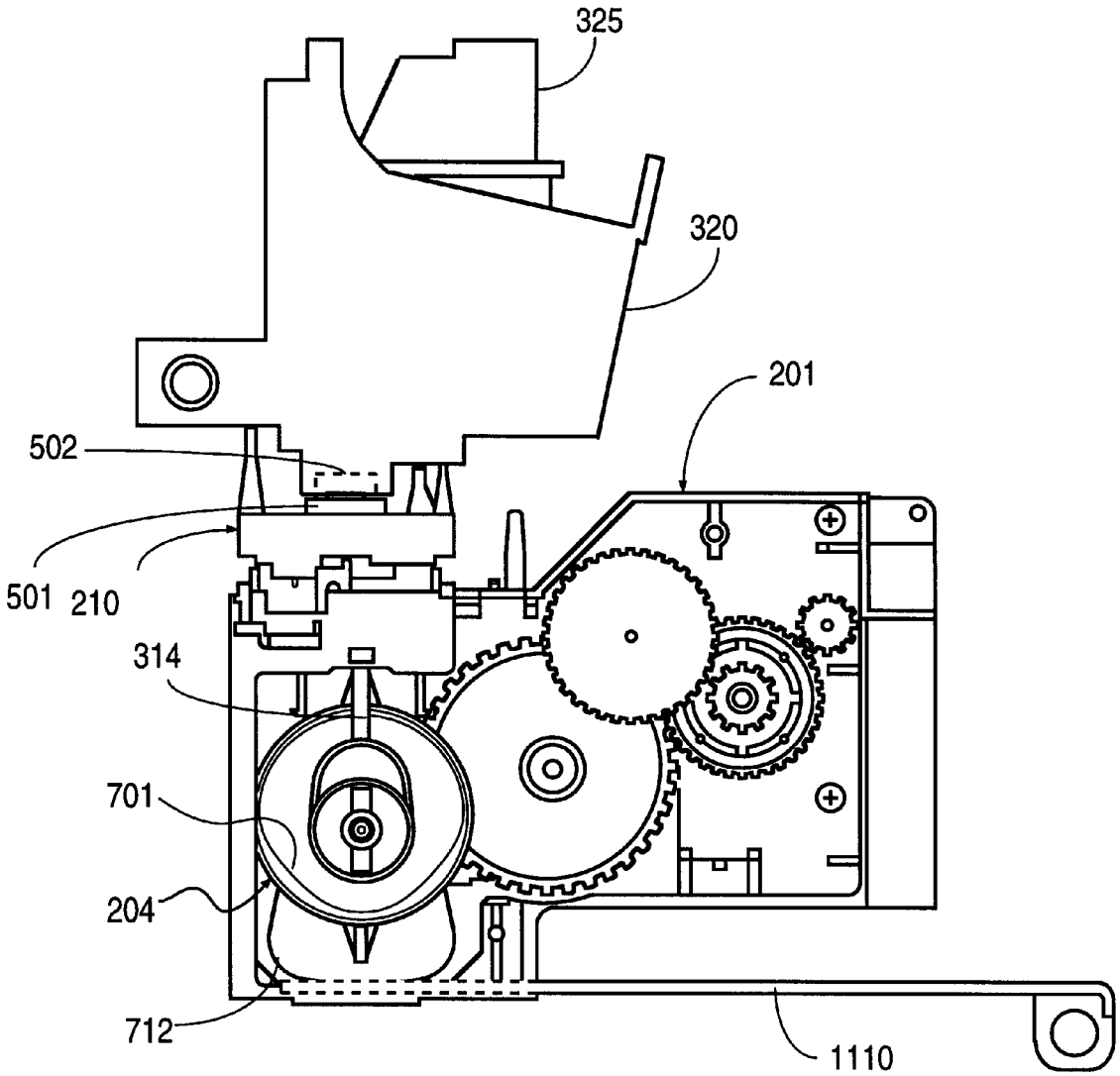
FIG. 11B is a simplified side view, similar to that of FIG. 7B, of the service station and paper pick pressure plate of FIG. 11A when the sled assembly is in a capping position and the paper pick pressure plate is in a paper release position.

A stack of print media 1130 is positioned on the paper pick pressure plate 1110. When the dual cam mechanism 204 is positioned in the paper release position shown in FIG. 11A, i.e., with the cam 712 contacting an extended portion of the paper pick pressure plate 1110, the paper pick pressure plate 1110 is pushed away from the pick rollers 1120 so that the top sheet of the print media 1130 does not contact the pick rollers 1120 (see also FIG. 11B below). At the same time, the cam ring 701 (FIG. 11B) interacts with the cam follower 314, as described above with respect to FIG. 7B, to move the sled assembly 210 to the raised (i.e., capping) position. FIG. 11B is a simplified side view, similar to that of FIG. 7B, of the service station 110 and paper pick pressure plate 1110 when the sled assembly 210 is in a capping position and the paper pick pressure plate 1110 is in a paper release position. Thus, as is evident, while the print cartridge printheads are capped, printing does not occur and the paper pick pressure plate 1110 is positioned so that the top sheet of the print media 1130 is not drawn into a printing path.

Figure 11C:
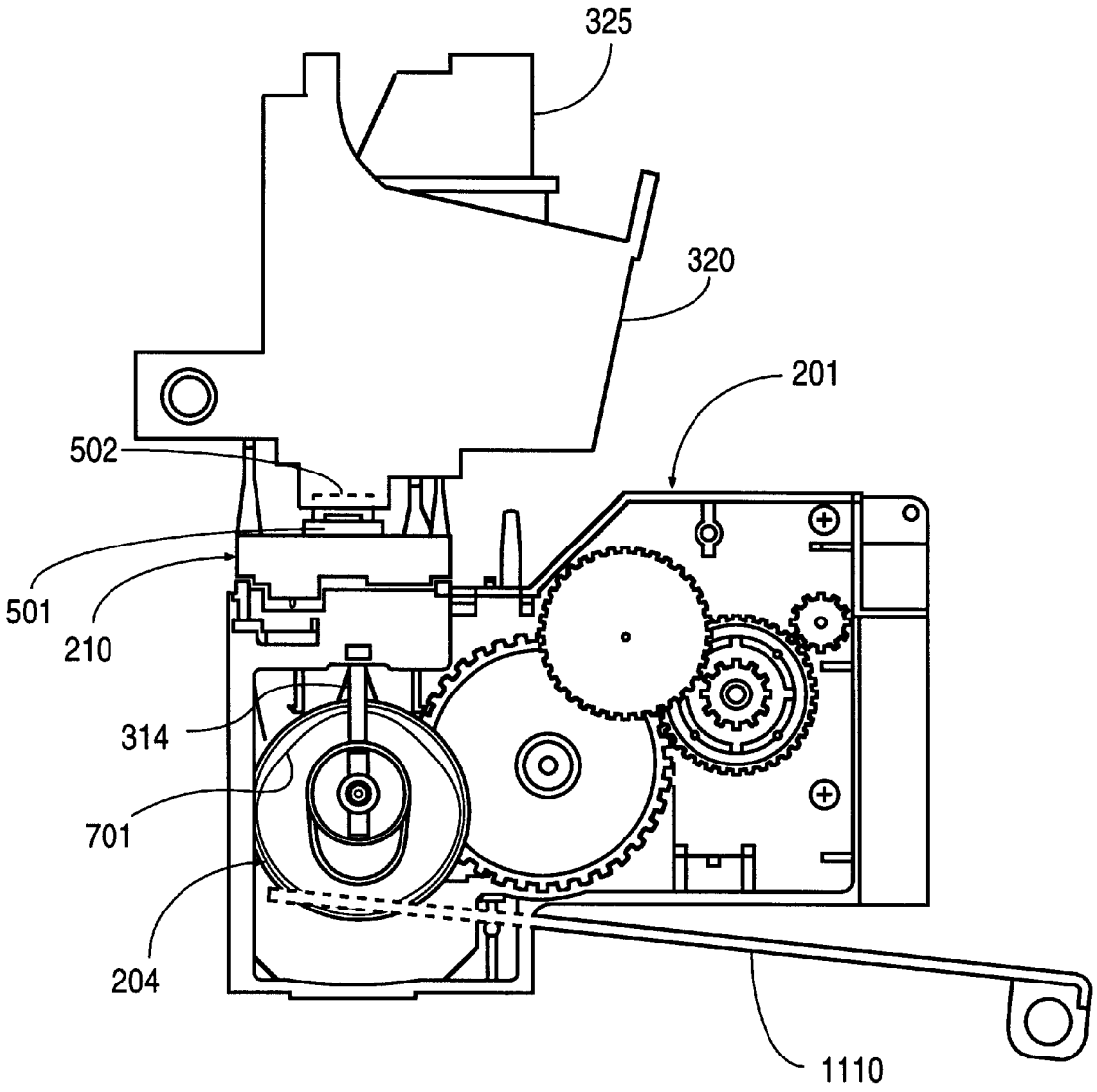
FIG. 11C is a simplified side view, similar to that of FIG. 7A, of the service station and paper pick pressure plate of FIG. 11A when the sled assembly is in a wiping position and the paper pick pressure plate is in a paper pick position.

FIG. 11C is a simplified side view, similar to that of FIG. 7A, of the service station 110 and paper pick pressure plate 1110 when the sled assembly 210 is in a wiping position and the paper pick pressure plate 1110 is in a paper pick position. In the position shown in FIG. 11C, the dual cam mechanism 204 is rotated to a position in which the cam ring 701 interacts with the cam follower 314, as described above with respect to FIG. 7A, to move the sled assembly 210 to the lowered (i.e., wiping) position shown in FIG. 11C, and the cam 712 is rotated to an up position that allows the spring 1112 to bias the paper pick pressure plate 1110 against the paper pick rollers 1120 (FIG. 11A), thereby causing the top sheet of the print media 1130 to contact the pick rollers 1120. The microprocessor causes the shaft 1121 to rotate, the pick rollers 1120 rotating with the shaft 1121. The frictional force between the rotating pick rollers 1120 and the top sheet of the print media 1130 causes the top sheet to be drawn away from the stack of print media 1130 into the printing path of the facsimile machine 100. A paper guide (not shown) directs the sheet of the print media 1130 around the pick rollers 1120 and into a print zone (not shown) where printing occurs. Thus, after the print cartridge printheads are wiped, printing occurs and the paper pick pressure plate 1110 is positioned so that paper can be drawn into the printing path by rotation of the paper pick rollers 1120.

As described above, both the position of the sled assembly 210 for print cartridge servicing and the position of the paper pick pressure plate 1110 for feeding paper into the printing path are controlled by a single motor 202 driving a single mechanism (dual cam mechanism 204). In contrast, previous service stations required two motors, each motor driving a separate positioning mechanism one for moving the sled assembly and one for moving the paper pick pressure plate. Thus, the service station according to the invention achieves functionality equivalent to that of previous service stations with a simpler structure that is easier to construct, less likely to break down, and requires less space within the printing assembly. The previously mentioned microprocessor synchronizes operation of the motor 202 with the motor that drives the print carriage 320 so that movement of the print carriage 320 (FIG. 3) is properly synchronized with the movement of the sled assembly 210 and paper pick pressure plate 1110.

Figure 12:
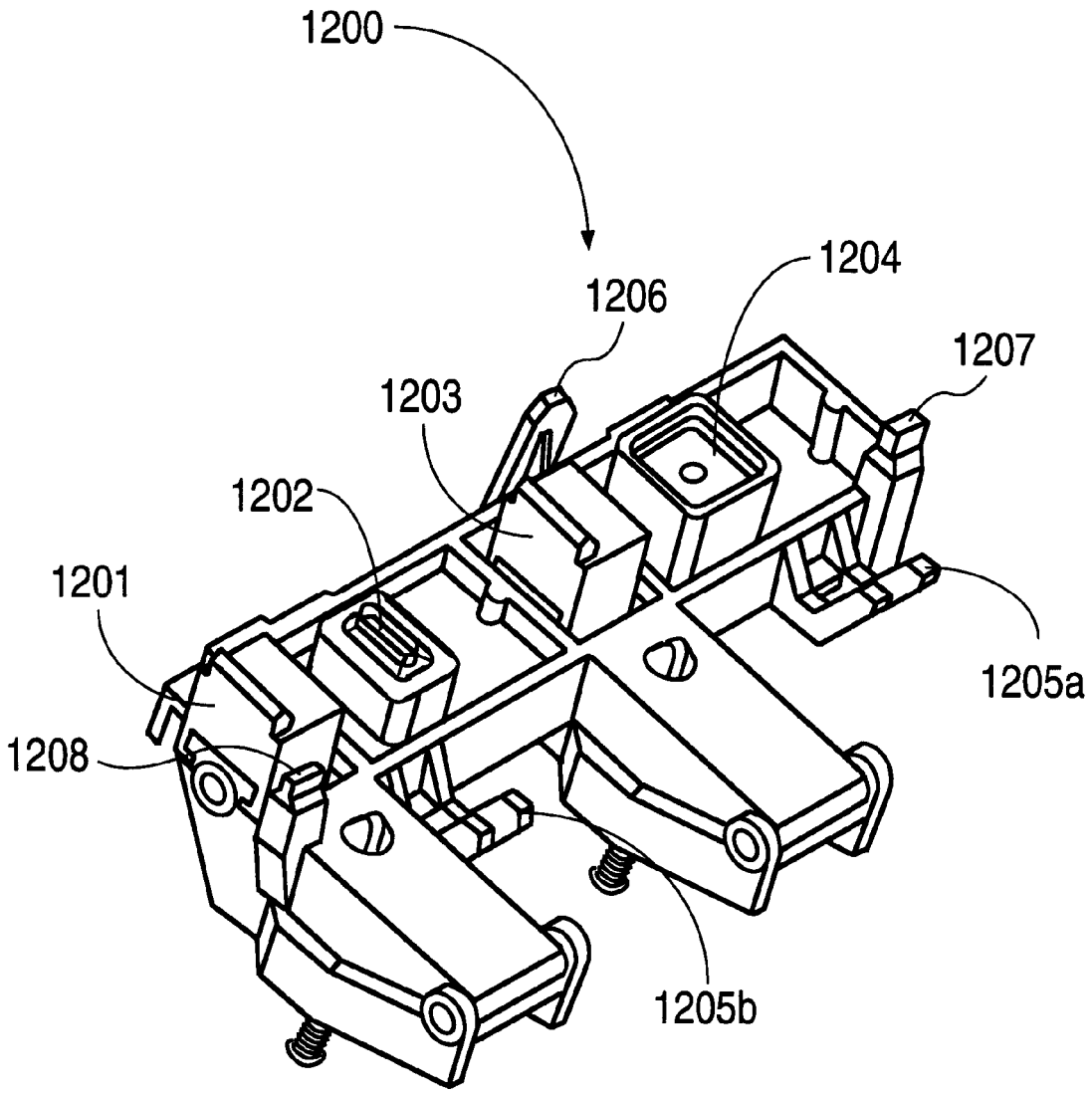
FIG. 12 is a top perspective view of a sled assembly for use in a service station according to another embodiment of the invention.

FIG. 12 is a top perspective view of a sled assembly 1200 for use in a service station according to another embodiment of the invention. As shown in FIG. 12, the sled assembly 1200 is configured to enable servicing of two print cartridges at a time, and includes wipers 1201, 1203 and caps 1202, 1204. However, similar sled assemblies in accordance with the invention could be configured to service other numbers of print cartridges at one time typically, such a sled assembly includes one wiper and one cap for each print cartridge to be serviced at the same time. The wipers 1201, 1203 and caps 1202, 1204 can be made of any appropriate material, such as materials (e.g., EPDM rubber) having the characteristics described above with respect to FIG. 5 for the wiper 502 and cap 501. The wipers 1201, 1203 and caps 1202, 1204 can also have any appropriate shape, dimensions, construction and manner of assembly on to the sled assembly 1200, as known to those skilled in the art, that accomplishes the intended functions of the wipers 1201, 1203 and caps 1202, 1204. The particular characteristics of a sled assembly for use with a service station according to this embodiment of the invention are not critical; generally, any sled assembly that accomplishes desired servicing functions (including, necessarily, capping of a printhead) can be used.

The sled assembly 1200 also includes three posts 1206, 1207 and 1208. As will be better appreciated from the description below, the posts 1206, 1207 and 1208 fit into corresponding recesses formed in the print carriage in which the print cartridges are inserted. As will be apparent from the description below, positioning of the posts 1206, 1207 and 1208 against a surface or surfaces of the corresponding recesses positions the sled assembly 1200 (and, therefore, the caps 1202, 1204) with respect to the print carriage (and, therefore, the print cartridges) during capping of the print cartridges.

Figure 13A:
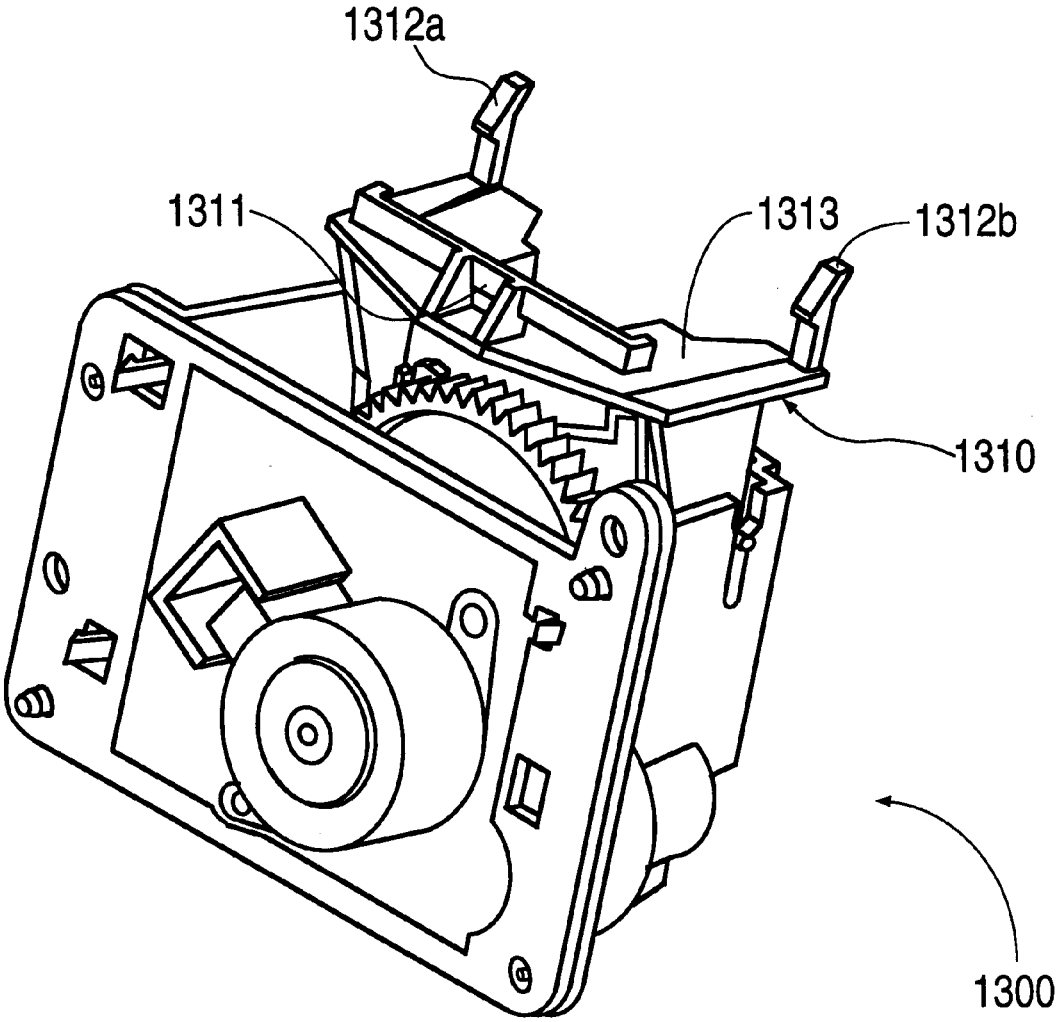
FIG. 13A is a top perspective view of a sled support structure for use with the sled assembly shown in FIG. 12.

FIG. 13A is a top perspective view of a sled support structure 1300 for use with the sled assembly 1200 shown in FIG. 12. The sled support structure 1300 includes a sled carrier 1310 (seen more completely in FIG. 13B, described below) to which the sled assembly 1200 is attached. The sled carrier 1310 includes retaining bar 1311 which is formed on the sled carrier 1310 to define an opening. The sled assembly 1200 is attached to the sled carrier 1310 as follows. The sled assembly 1200 is positioned so that a protrusion (not visible in FIG. 12, but located near the post 1206) formed on the sled assembly 1200 fits through the opening defined by the retaining bar 1311 of the sled carrier 1310. The protrusion on the sled assembly 1200 can make contact with the retaining bar 1311 so that the sled assembly 1200 can be pivoted about the retaining bar 1311 until the sled assembly 1200 is positioned on a sled support surface 1313 of the sled carrier 1310. As the sled assembly 1200 contacts the sled support surface 1313, each of retention arm grips 1205*a* and 1205*b*, formed on the sled assembly 1200, fit around corresponding retention arms 1312*a* and 1312*b*, respectively, formed on the sled carrier 1310. The retention arm grips 1205*a* and 1205*b* and corresponding retention arms 1312*a* and 1312*b* are shaped, and positioned on the sled assembly 1200 and sled carrier 1310, respectively, so that the retention arm grips 1205*a* and 1205*b* can snap fit about the respective retention arms 1312*a* and 1312*b* with the application of a moderate amount of force by a user, and so that the retention arm grips 1205*a* and 1205*b* are held in place by a frictional force sufficient to resist the forces to which the sled assembly 1200 and sled support structure 1300 are reasonably expected to be subjected during operation and handling. When the grips 1205*a* and 1205*b* are snapped into place so that the sled assembly 1200 is positioned on the sled support surface 1313, contact between the protrusion on the sled assembly 1200 and the retaining bar 1311 on the sled carrier 1310 holds the sled assembly 1200 in place along an axis perpendicular to the surface 1313 of the sled carrier 1310.

Figure 13B:
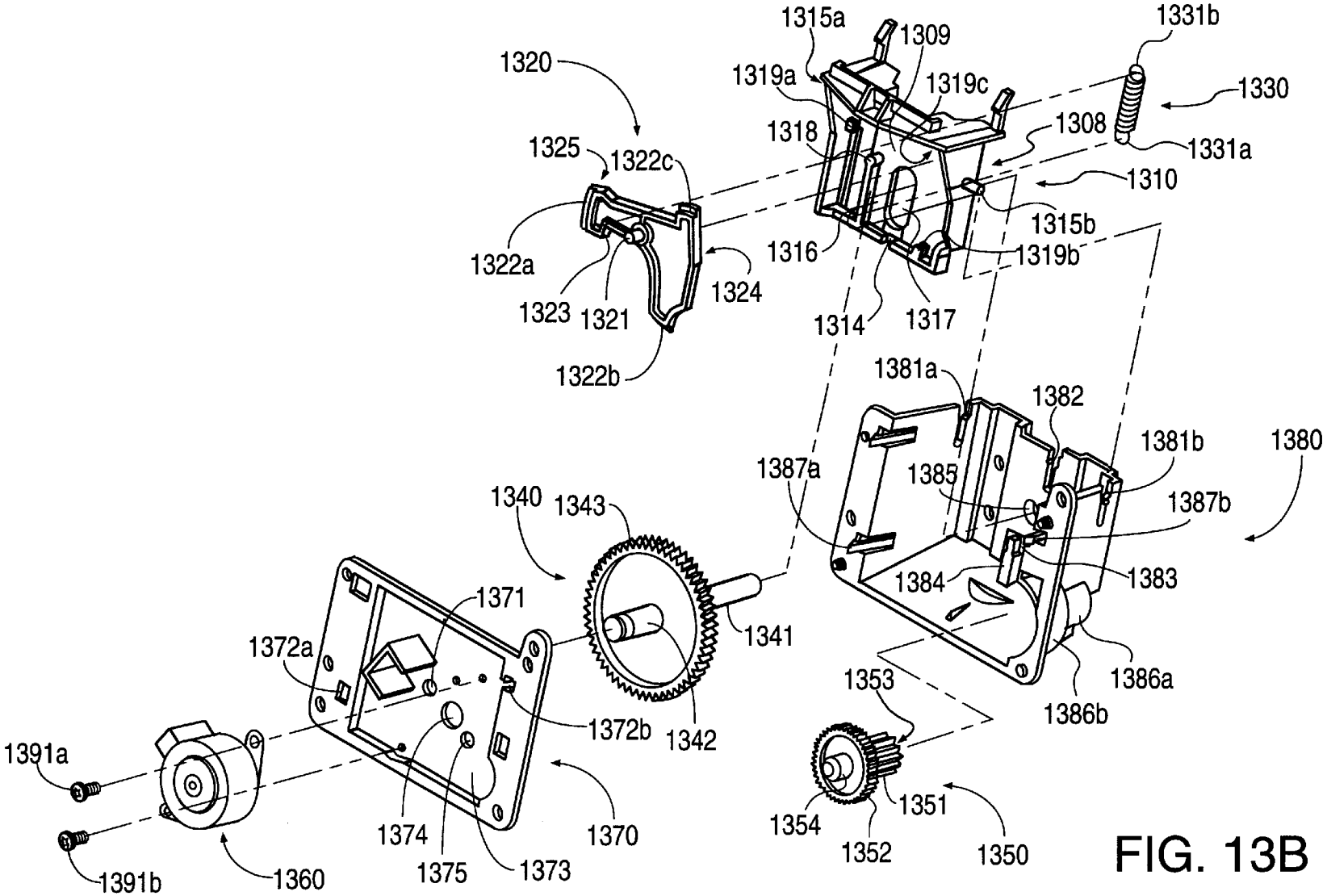
FIG. 13B is an exploded perspective view of the sled support structure shown in FIG. 13A.

FIG. 13B is an exploded perspective view of the sled support structure 1300 shown in FIG. 13A. A cam follower 1320 is positioned against the wall 1309 of the sled carrier 1310. Recessed edges 1322*a*, 1322*b* and 1322*c* formed on the cam follower 1320 fit within slots formed on the sled carrier 1310 by protuberances 1319*a*, 1319*b* and 1319*c* (protuberance 1319*c* is not visible in FIG. 13B) to retain the cam follower 1320 against the wall 1309 of the sled carrier 1310. A shaft extension (not visible in FIG. 13B, but indicated by the numeral 1324) formed on the cam follower 1320 fits into a corresponding hole (not visible in FIG. 13B, but indicated by the numeral 1309) formed in the sled carrier 1310. The shaft Extension 1324 (together with the spring 1330, discussed below) holds the cam follower 1320 in place so that the cam follower 1320 can rotate about the shaft extension 1324, but cannot translate with respect to the sled carrier 1310.

A looped end 1331*a* formed at one end of a spring 1330 is fitted over a retention rod 1316 (barely visible in FIG. 13B) formed on the sled carrier 1310. A looped end 1331*b* formed at the end of the spring 1330 opposite the looped end 1331*a* is fitted over a retention rod (not visible in FIG. 13B, but indicated by the numeral 1325) formed on the cam follower 1320. The cam follower 1320 is formed with an interior corner 1323 that, when the sled carrier 1310 is in an uncapped position, as discussed below, rests against a stop 1318 formed on the sled carrier 1310. The geometry of the retention rod 1316 on the sled carrier 1310, the retention rod 1325 on the cam follower 1320 and the stop 1318 is established, together with the unstressed length of the spring 1330, so that the spring 1330 is stressed (preloaded) when the looped ends 1331*a* and 1331*b* of the spring 1330 are positioned over the retention rods 1316 and 1325.

The sled carrier 1310 (together with the cam follower 1320 and spring 1330) is positioned within a housing 1380 of the sled support structure 1300. Positioning rods 1315*a* and 1315*b* (only positioning rod 1315*b* is visible in FIG. 13B) formed on opposite sides of the sled carrier 1310 are fitted into corresponding slots 1381*a*, 1381*b* formed in walls of the housing 1380. A crossbar 1314 of the sled carrier 1310 is fitted into a slot 1383 formed on the housing 1380 by the retention arm 1384.

An enclosure plate 1370 is attached to the housing 1380 o form an enclosure that contains the sled carrier 1310, the cam follower 1320, the spring 1330, a cam gear 1340 and an idler gear 1350. As shown in FIG. 13B, the enclosure plate 1370 is attached to the housing 1380 by snap fitting catches 1387*a* and 1387*b* formed on the housing 1380 over edges of corresponding openings 1372*a* and 1372*b* formed in the enclosure plate 1370; however other modes of attachment (e.g., nuts and bolts, screws) could be used.

The cam gear 1340 (described in more detail below with respect to the FIG. 14) is rotatably supported by journalling a shaft 1341 of the cam gear 1340 within a hole 1385 formed in a wall of the housing 1380, and journalling an opposing shaft 1342 within a recess defined by a cylindrical wall formed on a surface (hidden from view in FIG. 13B) opposite a surface 1373 of the enclosure plate 1370 and coaxial with the hole 1371 formed in the enclosure plate 1370. (The shaft 1341 also extends past the cam follower 1320—under a cam follower extension 1321—and through an opening 1317 formed in the sled carrier 1310.) A hole (not visible in FIG. 13B, but indicated by the numeral 1353) formed in an idler gear 1350 fits over a shaft extension (also not visible in FIG. 13B) formed on a wall of the housing 1380 near the wells 1386*a* and 1386*b* that are formed in the housing 1380 to accommodate the corresponding teeth 1351 and 1352 of the idler gear 1350. A shaft extension 1354 formed on the idler gear 1350 opposite the hole 1353 is journalled in a recess defined by a cylindrical wall formed on the surface (hidden from view in FIG. 13B) opposite the surface 1373 of the enclosure plate 1370, and coaxial with the hole 1375 formed in the enclosure plate 1370. The teeth 1351 of the idler gear 1350 mesh with the teeth 1343 of the cam gear 1340.

A motor 1360 is attached, using screws 1391*a* and 1391*b* (other suitable modes of attachment could be used), to the surface 1373 of the enclosure plate 1370 exterior to the enclosure. A motor shaft (not visible in FIG. 13B) fits through a hole 1374 formed in the enclosure plate 1370. A gear (not visible in FIG. 13B) is attached to the motor shaft within the enclosure; the teeth of the gear mesh with the teeth 1352 of the idler gear 1350. The motor 1360 (which can be a conventional stepper motor) can be driven to rotate the gear attached to the motor shaft, thereby rotating the idler gear 1350 and thus the cam gear 1340. In a particular embodiment of the invention, the gear attached to the motor shaft is made of brass, and the idler gear 1350 and cam gear 1340 is made of polycarbonate. As with the similar embodiment of the gears of the service station 110, described above with respect to FIGS. 7A and 7B, the use of such materials reduces gear wear and gear noise.

Figure 14:
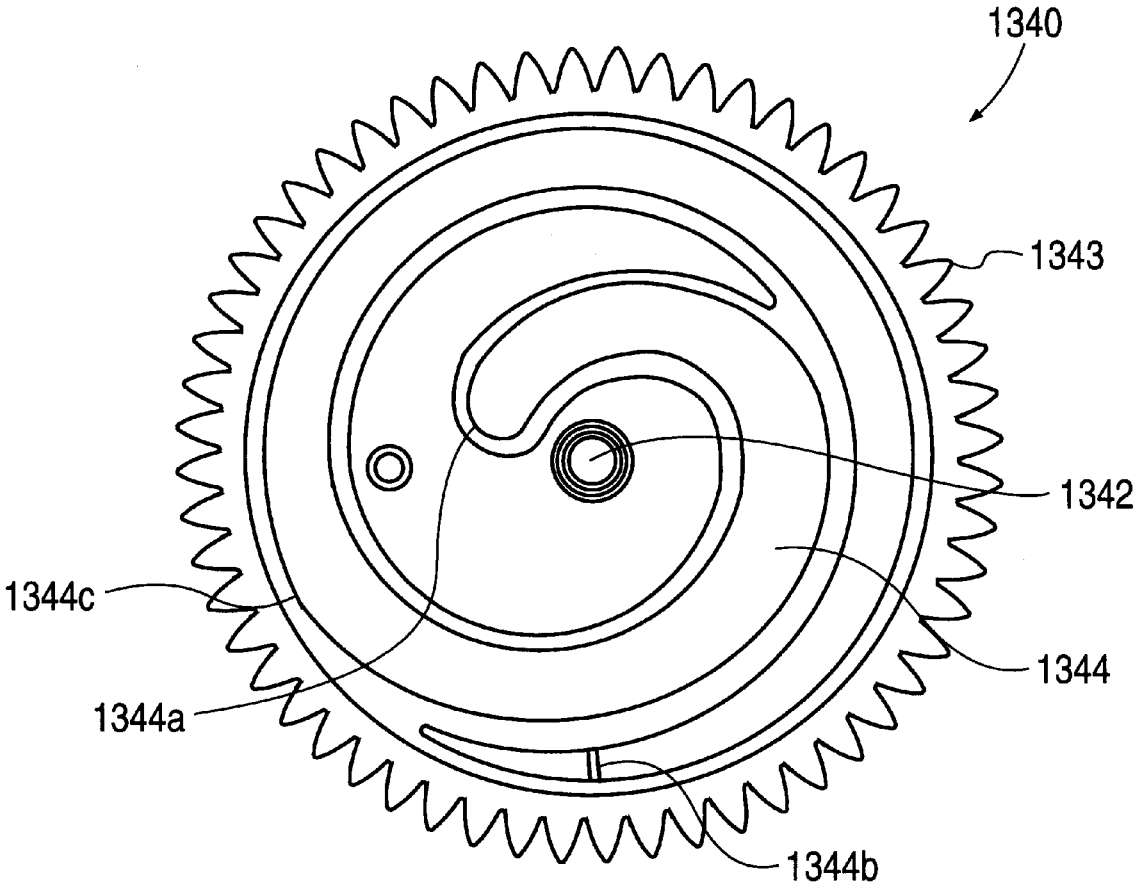
FIG. 14 is a side view of a cam gear for use with the sled support structure shown in FIGS. 13A and 13B.

FIG. 14 is a side view of the cam gear 1340, illustrating a channel 1344 ("spiral cam") formed in the surface of the cam gear 1340 that is hidden from view in FIG. 13B. The cam follower extension 1321 (see FIG. 13B) of the cam follower 1320 fits within the spiral cam 1344 when the sled support structure 1301) is assembled. When the cam gear 1340 is rotated, the cam follower extension 1321 moves within the spiral cam 1344. The cam gear 1340 can be rotated between a position in which the cam follower extension 1321 is positioned at an end 1344*a* of the spiral cam 1344 and a position in which the cam follower extension 1321 is positioned at an opposite end 1344*b* of the spiral cam 1344.

As a consequence of movement within the spiral cam 1344, the distance of the cam follower extension 1321 from the axis of rotation of the cam gear 1340 varies. Since, in the service station of this embodiment of the invention, the position (in particular, the position of the axis of rotation) of the cam gear 1340 stays fixed (except for rotation of the cam gear 1340) and does not translate, rotation of the cam gear 1340 causes the cam follower extension 1321—and, thus, the cam follower 1320—to move along an axis perpendicular to the sled support surface 1313. As discussed below, this movement of the cam follower 1320 can cause the sled carrier 1310—and, therefore, the sled assembly 1200 (and caps 1202 and 1204)—to move along the same axis. Thus, as can be better appreciated from the discussion of FIGS. 16A, 16B, and 16C below, the cam gear 1340 can be rotated to move the caps 1202, 1204 mounted on the sled assembly 1200 toward and away from corresponding printheads of a print cartridge positioned proximate to the sled assembly 1200.

Figure 15:
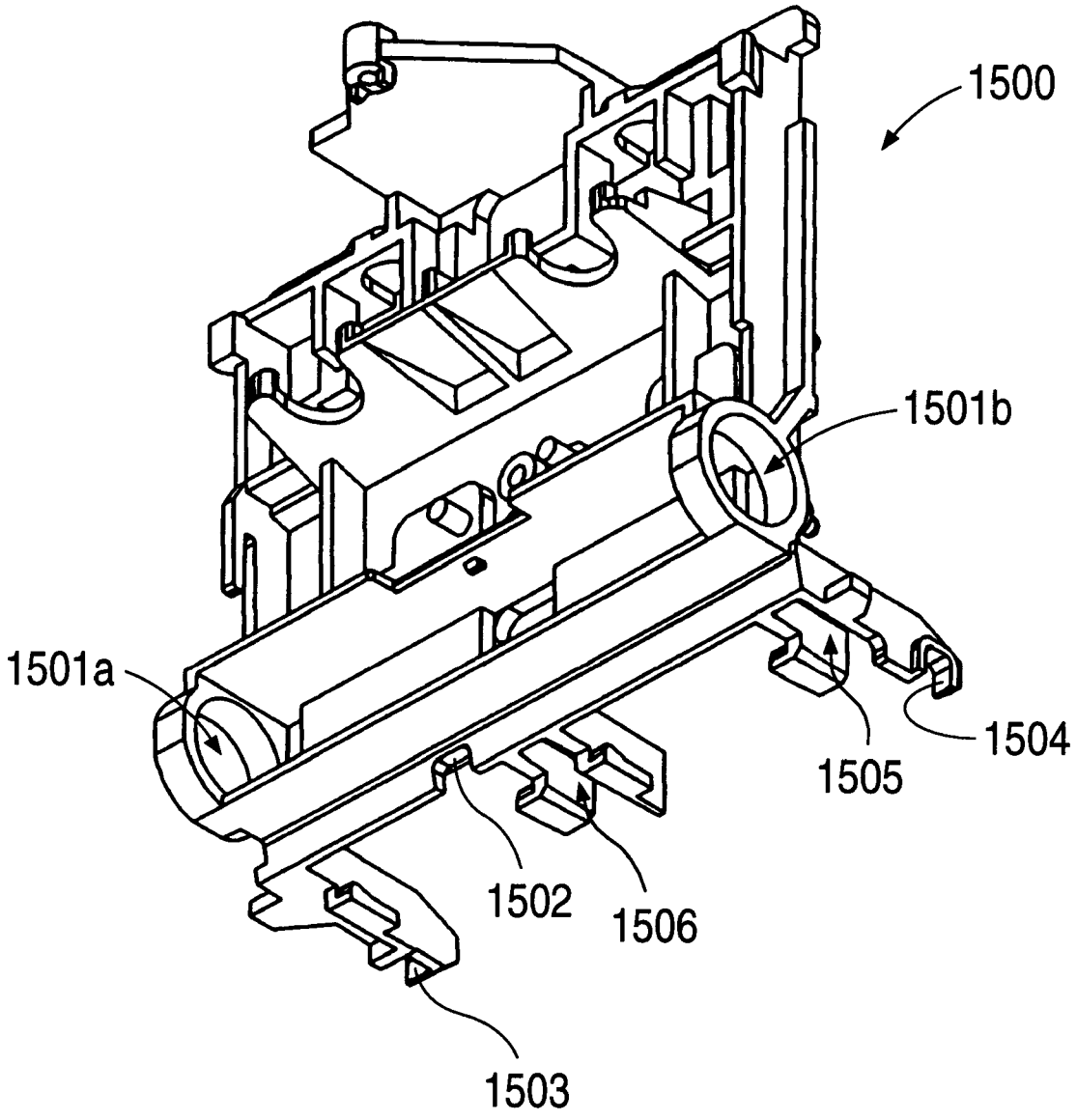
FIG. 15 is a bottom perspective view of a portion of a print carriage that can be used with a service station in accordance with the embodiment of the invention illustrated in FIGS. 12, 13A, 13B, 14, 16A, 16B and 16C.

FIG. 15 is a bottom perspective view of a portion 1500 of a print carriage that can be used with a service station in accordance with the embodiment of the invention illustrated in FIGS. 12, 13A, 13B, 14, 16A, 16B and 16C. The print carriage portion 1500 is formed with coaxial cylindrical openings 1501*a* and 1501*b* through which a slider bar (not shown) extends. The print carriage can move along the slider bar to enable printing on a print medium and to enable the print carriage to be moved into a service station, as described in more detail above. When the print carriage is moved into a capping position, the sled assembly 1200 (FIG. 12) is moved toward the print carriage so that the posts 1206, 1207 and 1208 formed on the sled assembly 1200 fit into corresponding recesses 1502, 1503 and 1504 formed in the print carriage portion 1500. In the capping position, when the posts 1206, 1207 and 1208 are moved into contact with the surfaces of the recesses 1502, 1503 and 1504, the wipers 1202 and 1204 (see FIG. 12) fit into corresponding recesses 1505 and 1506 formed in the print carriage portion 1500, so that the wipers 1202, 1204 do not interfere with the print carriage. The contact between the posts 1206, 1207 and 1208 and the recesses 1502, 1503 and 1504 position the sled assembly 1200 with respect to the print carriage in each of the three orthogonal printer axes.

Figure 16A:
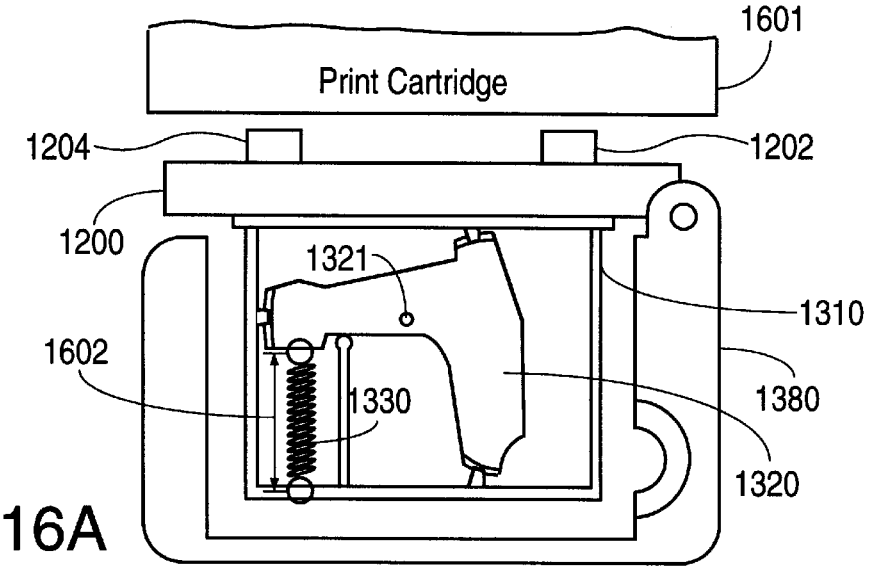
FIG. 16A is a side view of the interior of the sled support structure shown in FIGS. 13A and 13B, illustrating the position of a sled carrier and a cam follower of the sled support structure when the sled assembly is in an uncapped position.

FIG. 16A is a side view of the interior of the sled support structure 1300 shown in FIGS. 13A and 13B, illustrating the position of the sled carrier 1310 and cam follower 1320 of the sled support structure 1300 when the sled assembly 1200 is in an unmapped position. (In FIGS. 16A, 16B and 16C, the structure shown in FIGS. 12, 13A and 13B has been simplified somewhat for clarity.) In the uncapped position shown in FIG. 16A, the cam gear 1340 (not shown in FIG. 16A) is rotated 1to a position in which the cam follower extension 1321 is positioned at the end 1344*a* of the spiral cam 1344. In this position, the cam follower 1320 is positioned as far as possible (in the service station according to this embodiment) from the printheads of a print cartridge 1601; thus, the sled carrier 1310 and the sled assembly 1200 positioned thereon (and, in particular, the caps 1202 and 1204) are positioned as far as possible from the printheads. In an uncapped position, such as that shown in FIG. 16A, the spring 1330 is preloaded (i.e., the spring 1330 has been stretched to a length 1602 that, in accordance with the known spring constant of the spring 1330, produces a force of a desired a-mount). The actual preload of the spring 1330 depends upon the particular characteristics of the service station and the printing apparatus with which the service station is used. Illustratively, the nominal preload of the spring 1330 can be approximately 700 grams.

Figure 16B:
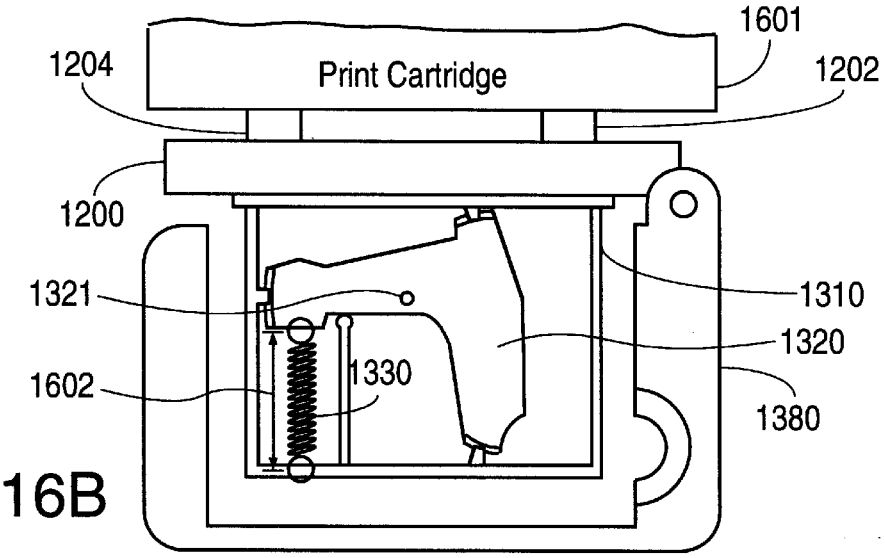
FIG. 16B is a side view of the interior of the sled support structure shown in FIGS. 13A and 13B, illustrating the position of the sled carrier and cam follower shown in FIG. 16A when the sled assembly is in a position in which a cap of the sled assembly first makes contact with a printhead of a corresponding print cartridge.

FIG. 16B is a side view of the interior of the sled support structure 1300 shown in FIGS. 13A and 13B, illustrating the position of the sled carrier 13and cam follower 1320 shown in FIG. 16A when the sled assembly 1200 is in a position in which the posts 1206, 1207 and 1208 of the sled assembly 1200 have made contact with corresponding recesses 1502, 1503 and 1504 of the print carriage. As indicated above, rotation of the cam gear 1340 (which can be produced by the motor 1360) causes the cam follower 1320 to move along an axis perpendicular to the printheads of the print cartridge 1601. As the cam gear 1340 rotates from the position shown in FIG. 16A, the spring 1330 holds the cam follower 1320 in place with respect to the sled carrier 1310 so that the sled carrier 1310 (and sled assembly 1200) moves along with the cam follower 1320. Eventually, as shown in FIG. 16B, the cam gear 1340 is rotated until the cam follower 1320 and sled carrier 1310 have been moved to cause contact between the posts 1206, 1207 and 1208 of the sled assembly 1200 and the recesses 1502, 1503 and 1504 of the print carriage portion 1500. In this position, the caps 1202 and 1204 contact the corresponding printheads.

Tolerances associated with the manufacture, assembly and operation of an inkjet printing assembly of which the service station according to this embodiment is part can make the exact position of the posts 1206, 1207 and 1208 at any rotational position of the cam gear 1340 uncertain. Therefore, the motor 1360 can rotate the cam gear 1340 past a nominal position at which the posts 1206, 1207 and 1208 should contact the corresponding recesses 1502, 1503 and 1504, so that adequate seating between the posts 1206, 1207 and 1208 and the recesses 1502, 1503 and 1504 is assured. As the motor 1360 continues to rotate the cam gear 1340 after contact between posts 1206, 1207 and 1208 and the recesses 1502, 1503 and 1504 occurs—and the cam follower 1320 continued to move, thus providing a force to move the sled carrier 1310—the print carriage (which remains fixed) begins to apply a force to the sled carrier 1310 in opposite direction to that applied by the cam follower 1320. When the force applied by the print carriage exceeds the preload of the spring 1330, the cam follower extension 1321—which continues to move in response to rotation of the cam gear 1340—begins to move relative to the sled carrier 1310. The shaft extension 1324—which fits into a hole formed in the sled carrier 1310—remains fixed with respect to the sled carrier 1310. Consequently, the cam follower 1320 begins to rotate about the shaft extension 1324. This rotation causes the spring 1330 to elongate further. As the spring 1330 elongates, the spring 1330 provides a progressively greater force in resistance to the relative movement of the cam follower extension 1321 and sled carrier 1310. Thus, continued rotation of the cam gear 1340 causes the posts 1206, 1207 and 1208 to contact the recesses 1502, 1503 and 1504 of the print carriage with a compliant, but increasing force.

Figure 16C:
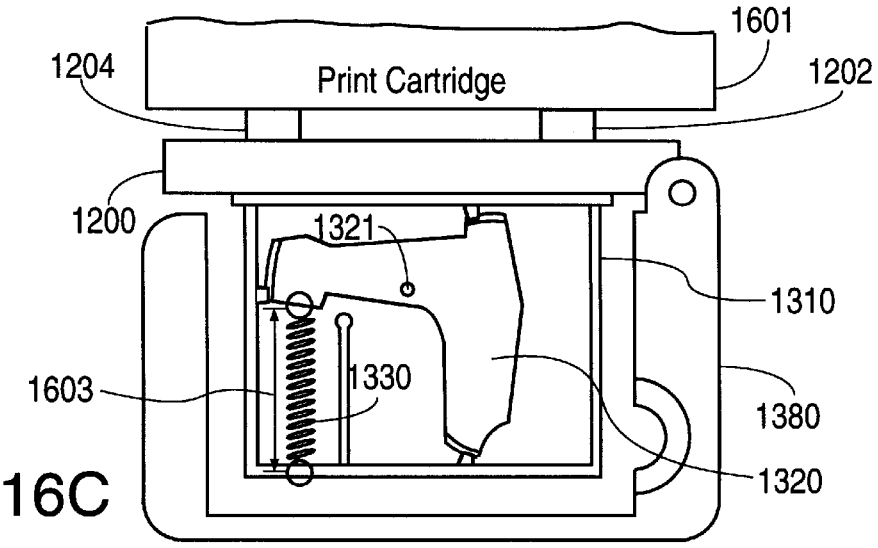
FIG. 16C is a side view of the interior of the sled support structure shown in FIGS. 13A and 13B, illustrating the position of the sled carrier and cam follower shown in FIG. 16A when the sled assembly is in a capped position.

FIG. 16C is a side view of the interior of the sled support structure 1300 shown in FIGS. 13A and 13B, illustrating the position of the sled carrier 1310 and cam follower 1320 shown in FIG. 16A when the cam gear 1340 (not shown in FIG. 16C) is rotated to a position in which the cam follower extension 1321 is positioned at the end 1344*b* of the spiral cam 1344. In this position, the spring 1330 is elongated to a length 1603 that is greater than the length 1602 (FIG. 16A)

of the spring 1330 when the sled assembly 1200 is in an uncapped position. Preferably, the spiral cam 1344 is formed with dwell, i.e., before the cam follower extension 1321 reaches the end 1344*b* of the spiral cam 1344, the cam follower extension stops moving further from the axis of rotation of the cam gear 1340.

Various embodiments of the invention have been described. The descriptions are intended to be illustrative, not limitative. Thus, it will be apparent to one skilled in the art that certain modifications may be made to the invention as described without departing from the scope of the claims set out below.

We claim:

1. An inkjet printer service station for servicing a carriage mounted printhead cartridge movable between a printing position and a servicing position, comprising:

a sled chassis mounted fixedly in a service station position to facilitate the servicing of the printhead cartridge when it is disposed at the servicing position;

a spring biased sled secured removably to said sled chassis, said sled including:

a sled base having a wiper for cleaning a nozzle surface of the print cartridge and a cap for enclosing the printhead cartridge; and an engagement member having a downwardly depending cam follower;

a cam positioned to interact with the cam follower such that movement of the cam causes corresponding movement of the cam follower along an axis perpendicular to the printhead cartridge;

a motor coupled to said cam for causing it to move between a first position and a second position, a third position being intermediate the first position and the second position, wherein:

when the cam is in the first position, the sled is positioned in an uncapped position in which the cap does not contact the printhead cartridge; and when the cam is in the third position, the sled is positioned in a capped position in which the cap contacts the printhead cartridge; and wherein said sled further includes a spring disposed between said sled base and said engagement member for compliantly supporting said sled base to permit the printhead cartridge to engage and push said cap in an opposite direction away from the printhead cartridge to relieve high load interference pressure between said cap and said printhead cartridge when said sled is moved to said cap position and for facilitating the attaching of the cam follower to the sled base, such that movement of the cam between the third position and the second position causes the cam follower to move relative to the sled base along the axis perpendicular to the printhead cartridge.

2. An inkjet printer service station according to claim 1, wherein:

the cam further comprises a channel formed in a spiral;

the cam follower further comprises an extension mounted within the channel; and the motor rotating said cam so said extension moves within the channel, such movement positioning the extension at varying distances from a fixed axis of rotation of the cam, thereby moving the cam follower.

3. An inkjet printer service station according to claim 1, wherein said spring is a coil spring.

4. An inkjet printer service station according to claim 1, wherein a fourth position is intermediate the third position and the second position, such that movement of the cam between the fourth position and the second position does not cause the cam follower to move relative to the sled chassis along the axis perpendicular to the printhead cartridge.

5. A service station for facilitating the wiping and capping of an inkjet printer cartridge, comprising:

a service station chassis;

a sled removably attached to the service station chassis, said sled being movable along a rectilinear path of travel between a non servicing position, a wiping position, and a capping position to facilitate the servicing of the inkjet printer cartridge;

said sled including:

a spring biased base unit having an upstanding wiper mounted to said base for wiping the inkjet printer cartridge when said sled is in said wiping position;

an upstanding cap mounted to said base for capping the inkjet printer cartridge when said sled is in said capping position; and a cam follower depending downwardly from said base for helping to facilitate the movement of the sled along said rectilinear path of travel; and a motor driven cam movably attached to the service station chassis, said cam interacting with the cam follower to effect the rectilinear movement of the sled for both wiping and capping purposes.

6. A service station as in claim 5, wherein when the cam base unit is moved to a predetermined position, interaction of the cam and cam follower positions the base unit so that, if an inkjet print cartridge is opposite from the cap, the cap contacts a printhead of the inkjet print cartridge.

7. A service station as in claim 6, wherein when the cam base unit is moved to a second predetermined position, interaction of the cam and cam follower positions the base unit so that, if in inkjet print cartridge is opposite from the cap, the cap is positioned away from the printhead so that the cap does not contact the printhead.

8. A service station as in claim 5, wherein when the motor driven cam is moved to a predetermined position, wherein interaction of the cam and the cam follower positions the base unit so that a distal end edge of the wiper extends beyond an underside nozzle surface of the printhead to facilitate nozzle wipping when the print cartridge is moved past the wiper.

9. A service station as in claim 5, further comprising a motor attached to the service station chassis and coupled to the cam for driving the cam to facilitate the servicing of the printhead cartridge.

10. A service station as in claim 9, wherein:

said sled has a maximum width and said motor has a maximum width;

wherein the maximum width of the sled is along a first axis;

wherein the maximum width of the motor is along a second axis; and wherein the first axis is substantially perpendicular to the second axis.

11. A method for servicing an inkjet print cartridge disposed in a fixed plane at a service station position, comprising:

moving a service sled having a cap and a wiper along a first rectilinear path of travel to a wiping position;

moving the service sled along a second rectilinear path of travel to a capping position; and biasing the service sled with a spring to provide a constant engagement force as it caps the inkjet print cartridge, whereby a single single cam effects movement of both the wiper and the cap.

12. A method as in claim 11, wherein the step of moving includes:

positioning the cam at a predetermined position, the predetermined position being chosen so that the cam interacts with the cam follower to cause the sled to move to a position in which the cap contacts a printhead of an inkjet print cartridge when the print cartridge is opposite the cap.

13. A method as in claim 12, wherein the step of moving includes:

positioning the cam at a second predetermined position, the second predetermined position being chosen so that the cam interacts with the cam follower to cause the sled to move to a position in which the cap is displaced from the printhead when the print cartridge is opposite the cap.

14. A method as in claim 11, wherein the step of moving includes:

positioning the cam at a predetermined position, the predetermined position being chosen so that the cam interacts with the cam follower to cause the sled to move to a position in which an edge of the wiper distal from the sled surface extends beyond the printhead of the print cartridge by a predetermined amount to enable the wiper to wipe the printhead when the print cartridge is moved past the wiper.

15. A service station for use with an inkjet printer, comprising:

a service station chassis;

a sled movably attached to the service station chassis, said sled including a sled base having a surface, a wiper mounted on the surface of the sled base, a cap mounted on the surface of the sled base, a sled engagement mechanism coupled to the sled base, a cam follower being formed on the sled engagement mechanism, and a cam mechanism movably attached to the service station chassis;

a cam formed on the cam mechanism, wherein movement of the cam mechanism results in movement of the cam, the moving cam interacting with the cam follower to effect movement of said sled, whereby a single cam mechanism effects movement of both a wiper and a cap;

a motor coupled to the service station chassis to drive the cam mechanism; and wherein the cam mechanism includes a gear made of polycarbonate; and a driving gear that is rotatably coupled to the motor and that meshes with the cam mechanism gear, the driving gear being made of nylon.

16. A service station for use with an inkjet printer, comprising:

a service station chassis;

a sled movably attached to the service station chassis, said sled including a sled base having a surface, a wiper mounted on the surface of the sled base, a cap mounted on the surface of the sled base, a sled engagement mechanism coupled to the sled base, a cam follower formed on the sled engagement mechanism, and a cam mechanism movably attached to the service station chassis;

a cam formed on the cam mechanism, wherein movement of the cam mechanism results in movement of the cam, the moving cam interacting with the cam follower to effect movement of said sled, whereby a single cam mechanism effects movement of both a wiper and a cap; and a sensor trigger formed on said cam mechanism; and a sensing mechanism engages said sensor trigger as said cam mechanism moves, to facilitate a position indication of said cam mechanism.

17. A service station as in claim 16, further comprising:

a shaft rotatably mounted on the service station chassis, the cam mechanism being attached to the shaft, wherein the cam is a cam ring, the cam mechanism being attached to the shaft so the cam ring is positioned asymmetrically with respect to the axis of rotation of the shaft, whereby the asymmetric positioning causes the cam follower to move as the cam mechanism is rotated by the shaft.

18. A service station for use with inkjet printing apparatus, including a replaceable print cartridge having a printhead from which ink is ejected, comprising:

a sled including a wiper and a cap mounted on a surface of the sled;

means for positioning the sled in a first position in which the cap can contact the printhead and a second position in which the wiper can wipe the printhead;

a motor for driving the means for positioning;

said sled having a maximum width and said motor having another maximum width;

wherein the maximum width of tile sled is along a first axis, and the maximum width of the motor is along a second axis, and wherein the first axis is substantially perpendicular to the second axis;

a cam; and a cam follower, wherein one of the cam and the cam follower is formed as part of the sled, the other of the cam and the cam follower being operably coupled to the motor for driving the other of the cam and the cam follower so they interact to cause movement of the sled; and the cam mechanism includes a gear made of polycarbonate; and the means for positioning further comprises a gear train for transmitting motion of the motor to the cam, the gear train including i driving gear meshing with the cam mechanism gear, the driving gear being made of nylon.

19. A service apparatus for an inkjet printer cartridge, comprising:

a service station chassis;

a service sled removably secured to said service station chassis for facilitating the servicing of the inkjet printer cartridge, said service sled including an upstanding blade for wiping residual ink from the inkjet printer cartridge and an upstanding cover for capping the inkjet printer cartridge;

a single motor driven cam mounted to said service station chassis and coupled to said service sled for moving it along a rectilinear path of travel from a non servicing position to a first servicing position to facilitate wiping of residual ink from the inkjet printer cartridge, and hence moving it along another rectilinear path of travel to a second servicing position to facilitate capping the inkjet printer cartridge; and a spring disposed between said service sled and said cam for helping to bais said service sled into engagement with the inkjet printer cartridge with a substantially constant engagement force.

20. A service apparatus according to claim 19, wherein said constant engagement force is a sufficient force to facilitate the capping of the inkjet printer cartridge, but not a sufficient force to damage the inkjet printer cartridge due to excess interference between it and the service sled cap.

21. A service apparatus according to claim 20, further comprising: a finger engageable release arrangement partially disposed on said service station chassis and partially disposed on said service sled for disengaging said service sled from said service station chassis to facilitate the replacement of said blade.

22. A method of using a service sled having a wiper and a cap for servicing an inkjet printer cartridge, comprising:

mounting a service station chassis in a fixed plane relationship with the inkjet printer cartridge;

securing removably the service sled to said service station chassis;

moving the service sled along a rectilinear path of travel between a non servicing position and a first servicing position to facilitate wiping of residual ink from the inkjet printer cartridge;

moving the service sled along another rectilinear path of travel between said first servicing position and a second servicing position to facilitate capping the inkjet printer cartridge; and adjusting the position of the service sled relative to the inkjet printer cartridge when said service sled is positioned in said second servicing position so that the service sled engages the inkjet printer cartridge with a substantial constant force;

said constant force being a sufficient force to facilitate the capping of the inkjet printer cartridge, but not a sufficient force to damage the inkjet printer cartridge due to excess interference between it and the service sled.

23. A method of using a service sled according to claim 22, further comprising:

disengaging said service sled from said service station chassis to facilitate the replacement of said blade; and securing subsequently the service sled to said service station chassis after blade replacement.

* * * * *